US009223266B2

(12) United States Patent
Hara

(10) Patent No.: US 9,223,266 B2
(45) Date of Patent: Dec. 29, 2015

(54) IMAGE HEATING APPARATUS INCLUDING AN ENDLESS BELT CONFIGURED AND POSITIONED TO HEAT A TONER IMAGE ON A SHEET

(71) Applicant: CANON KABUSHIKI KAISHA, Tokyo (JP)

(72) Inventor: Nobuaki Hara, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/056,210

(22) Filed: Oct. 17, 2013

(65) Prior Publication Data

US 2014/0112678 A1 Apr. 24, 2014

(30) Foreign Application Priority Data

Oct. 18, 2012 (JP) ..... 2012-230785

(51) Int. Cl.
*G03G 15/20* (2006.01)

(52) U.S. Cl.
CPC ..... *G03G 15/205* (2013.01); *G03G 2215/2035* (2013.01)

(58) Field of Classification Search
CPC ..... G03G 15/205; G03G 2215/2036
USPC ..... 399/70, 69
See application file for complete search history.

(56) References Cited

U.S. PATENT DOCUMENTS 4,656,338 A * 4/1987 Yagasaki et al.
5,771,421 A * 6/1998 Kim ..... 399/70
7,907,882 B2 3/2011 Hara
8,290,387 B2 10/2012 Hara
8,554,097 B2 10/2013 Hara et al.
2005/0191076 A1* 9/2005 Dan ..... 399/70
2009/0052955 A1* 2/2009 Tatematsu et al.
2012/0027480 A1 2/2012 Hara
2012/0107005 A1* 5/2012 Hase et al. ..... 399/70
2012/0155934 A1 6/2012 Takeuchi et al.
2012/0228285 A1* 9/2012 Takahashi
2013/0034363 A1 2/2013 Hara

FOREIGN PATENT DOCUMENTS

JP 2011-53597 A 3/2011
JP 2012-128312 A 7/2012

OTHER PUBLICATIONS

U.S. Appl. No. 14/011,180, filed Aug. 27, 2013, Nobuaki Hara.

* cited by examiner

*Primary Examiner* — Susan Lee

(74) *Attorney, Agent, or Firm* — Fitzpatrick, Cella, Harper & Scinto

(57) ABSTRACT

An image heating apparatus includes: an endless belt for heating a toner image on a sheet in a nip; a driving rotatable member for cooperating with the belt to form the nip and for rotating the belt; a pressing pad for pressing the belt from an inside of the belt toward the driving rotatable member; a heating device for heating the belt; and a controller configured to execute, in a stand-by mode following a warming-up mode, an intermittent heating operation of the heating device for the belt while rotating the belt by the driving rotatable member. The controller is capable of executing, after executing the intermittent heating operation in a first rest period in the stand-by mode, the intermittent heating operation in a second rest period, which is longer than the first rest period.

19 Claims, 12 Drawing Sheets

IMAGE HEATING APPARATUS INCLUDING AN ENDLESS BELT CONFIGURED AND POSITIONED TO HEAT A TONER IMAGE ON A SHEET

FIELD OF THE INVENTION AND RELATED ART

The present invention relates to an image heating apparatus for heating a toner image on a sheet of recording medium.

An example of an apparatus which may be listed as an image heating apparatus is a fixing apparatus (device) for fixing an unfixed image formed on a sheet of recording medium, or a temporarily fixed image on a sheet of recording medium, to the sheet of recording medium by heating the image. Another example of such an apparatus is a glossing apparatus (device) for improving a fixed image on a sheet of recording medium in gloss (apparatus for improving fixed image in properties).

A conventional fixing apparatus (device) mounted in an image forming apparatus such as an electrophotographic copy machine and the like is configured to fix the toner image on a sheet of recording medium by heating the sheet and the toner image thereon while conveying the sheet, with the sheet and the toner image thereon pinched by its fixing means.

There has been continuously desired to reduce a fixing device in its startup time (length of time necessary to ready fixing device for fixation after pressing of main switch of image forming apparatus, that is, length of warm-up time necessary for warmup mode), in order to reduce the length of time a user has to wait until an image forming apparatus becomes ready for an image forming operation.

Thus, the fixing device disclosed in Japanese Laid-open Patent Application 2012-128312 is provided with a thin fixation belt (endless belt), a pressure roller (rotational driving member) which forms a nip between itself and the fixation belt, a pressure pad, etc. It is structured so that as the pressure roller is driven, a sheet of recording medium on which an image is present is conveyed through the nip in which the image on the sheet is fixed to the sheet (image is heated). Further, it is structured so that the fixation belt is pressed upon the pressure roller by the pressure pad. That is, a fixation belt (thin fixation belt) which is low in thermal capacity is employed to reduce the fixing device in the length of time necessary to startup the fixing device.

Further, in the case of the fixing device disclosed in Japanese Laid-open Patent Application 2012-128312, unless it receives a print command while it is operated in the warmup mode, it will be put in the standby mode as soon as the warmup mode ends. Further, while the fixing device is kept in the standby mode, the fixation belt is neither heated, nor rotated.

In the case of a fixing device whose standby mode is like the above described one, when it receives a print start command, its pressure roller is not warm (hot) enough for image fixation. Thus, if it receives such a print start command that requires the image forming apparatus to form an image on a substantial number of recording medium, while it is kept in the standby mode, it is possible that it will be impossible for the apparatus to complete the image forming operation while remaining the same in productivity (image formation speed).

Thus, a fixing device is desired to be structured so that even when it is kept in the standby mode, the fixation belt is rotated while being heated to keep the pressure roller warm. However, it is possible that as the fixation belt is rotated, it is deteriorated by the friction between the fixation belt and pressure pad.

SUMMARY OF THE INVENTION

According to an aspect of the present invention, there is provided an image heating apparatus comprising an endless belt configured and positioned to heat a toner image on a sheet in a nip; a driving rotatable member configured and positioned to cooperate with said endless belt to form the nip and to rotate said endless belt; a pressing pad configured and positioned to press said endless belt from an inside of said endless belt toward said driving rotatable member; a heating device configured and positioned to heat said endless belt; and a controller configured to execute, in a stand-by mode following a warming-up mode, intermittent heating operation of said heating device for said endless belt while rotating said endless belt by said driving rotatable member, wherein said controller is capable of executing, after executing the intermittent heating operation in a first rest period in the stand-by mode, the intermittent heating operation by a second rest period which is longer than the first rest period.

According to another aspect of the present invention, there is provided an image heating apparatus comprising an endless belt configured and positioned to heat a toner image on a sheet in a nip; a driving rotatable member configured and positioned to cooperate with said endless belt to form the nip and to rotate said endless belt; a pressing pad configured and positioned to press said endless belt from an inside of said endless belt toward said driving rotatable member; a heating device configured and positioned to heat said endless belt; a temperature sensor configured and positioned to detect a temperature of said endless belt; and a controller configured to control said heating device in accordance with an output of said temperature sensor; wherein in a stand-by mode, said controller operates said driving rotatable member when said heating device is operated, and stops said driving rotatable member when said heating device is stopped, wherein in the stand-by mode, said controller is capable of executing control of said heating device so that the temperature of said endless belt is maintained within a first temperature range, and then executing control of said heating device so that the temperature of said endless belt is maintained within a second temperature range having a lower limit temperature which is lower than that of the first temperature range.

According to a further aspect of the present invention, there is provided an image heating apparatus comprising an endless belt configured and positioned to heat a toner image on a sheet in a nip; a driving rotatable member configured and positioned to cooperate with said endless belt to form the nip and to rotate said endless belt; a pressing pad configured and positioned to press said endless belt from an inside of said endless belt toward said driving rotatable member; a heating device configured and positioned to heat said endless belt; and a controller configured to execute, in a, intermittent heating operation of said endless belt by said heating device, while rotating said endless belt by said driving rotatable member, wherein said controller is capable of executing a first mode operation in which said heating operation is intermittently carried out in a first rest period, and a second mode operation in which said heating operation is intermittently carried out in a second rest period which is longer than the first rest period.

These and other objects, features and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter the present invention is concretely described with reference to a couple of preferred embodiments of the present invention. These embodiments are examples of the embodiment of the present invention, and are not intended to limit the present invention in scope.

Embodiment 1

(1) Example of Image Forming Apparatus

Figure 1:
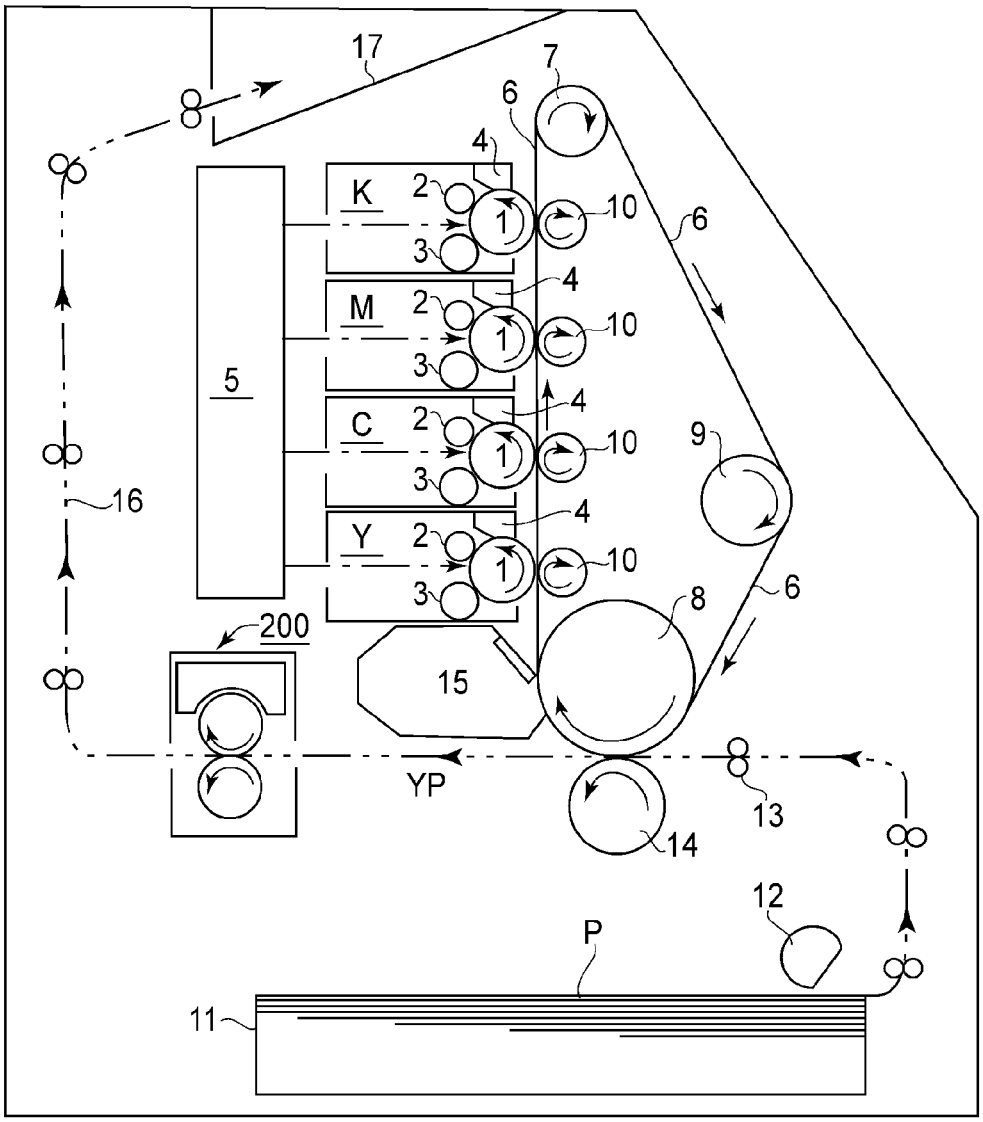
FIG. 1 is a schematic sectional view of a typical image forming apparatus with which the present invention is compatible, as seen from the front side of the apparatus. It shows the general structure of the apparatus.

FIG. 1 is a schematic sectional view of the image forming apparatus in which a fixing device 200, which is an example of image heating device in accordance with the present invention is mountable. It shows the general structure of the apparatus. This image forming apparatus is a color image forming apparatus (printer) which uses an electrophotographic image formation method. That is, this image forming apparatus is capable of forming on a sheet P of recording medium, a color image which reflects the electrical information of the image to be formed, which is inputted into the control circuit 100 of the image forming apparatus, from an external host apparatus 102 such as a personal computer. It can output the combination of the sheet P and the image thereon, as a print (hard copy), from its main assembly. Designated by a referential code 101 is a control panel, through which such information as various image formation conditions, types of recording medium used for image formation, etc., can be inputted into the control circuit 100. Further, the control panel 101 has a display portion across which various pieces of information are displayed.

Letters Y, C, M and K stand for the four image formation stations of the image forming apparatus, which form yellow, magenta, cyan and black toner images, respectively, and are vertically aligned in tandem, listing from the bottom side. Each of the image formation stations Y, M, C and K has a photosensitive drum 1, a charging device 2, a cleaning device 4, etc.

There are contained yellow (Y) and magenta (M) toners in the developing device 3 of the image formation station Y and developing device 3 of the image formation station M, respectively. Further, there are contained cyan (C) toner and black (K) toners in the developing device 3 of the image formation station C, and the developing device 3 of the image formation station K, respectively.

The image forming apparatus is provided with an optical system 5 for forming an electrostatic latent image on the peripheral surface of the drum 1 by exposing the peripheral surface of the drum 1. The optical system 5 is disposed so that it opposes the above described image formation stations Y, M, C and K which are different in the color of the image they form. More specifically, it is a laser based optical system for scanning (exposing) the peripheral surface of the drum 1.

The control circuit 100 is made up of a CPU, and memories such as a ROM and a RAM, in which image formation control sequences, various tables required by the fixing device when the fixing device is in the standby mode, various tables required by the image forming apparatus when the apparatus is in the standby mode, etc., are stored. The control circuit 100 begins to carry out an image formation control sequence in response to a print start signal inputted from the external host apparatus 102.

The image formation sequence of the image forming apparatus in this embodiment is as follows: As the control circuit 100 receives a print start signal, it begins to rotate the drum 1 in each of the image formation stations Y, C, M and K. As the drum 1 is rotated, its peripheral surface is uniformly charged by the charging device 2. The uniformly charged portion of the peripheral surface of the drum 1 is scanned by (exposed to) the beam of light emitted from the optical system 5 while being modulated according to the data of the image to be formed. Consequently, an electrostatic latent image, the pattern of which reflects the pattern in which the peripheral surface of the drum 1 was scanned (exposed), is formed on the peripheral surface of the drum 1.

The electrostatic latent image is developed by the developing device 3, into a color toner image. More specifically, on the drum 1 of the image formation station Y, a yellow (Y) toner image is formed. On the drum 1 of the image formation M, a magenta (M) toner image is formed. On the drum 1 of the image formation station C, a cyan (C) toner image is formed. Further, on the drum 1 of the image formation station K, a black (K) toner image is formed.

The color toner images, different in color, formed on the drums 1 of the image formation stations Y, M, C and K, one for one, are sequentially transferred in layers (primary transfer) onto a preset area of an intermediary transfer member 6, which is being roughly constantly rotated at a preset speed, in synchronism with the rotation of the drum 1. Consequently, an unfixed full-color toner image is synthetically effected on the intermediary transfer belt 6. The intermediary transfer belt 6 in this embodiment is an endless transfer belt, and is suspended and kept tensioned by three rollers, more specifically, a driver roller 7, a secondary transfer roller opposing roller 8, and a tension roller 9. It is driven by a driver roller 7.

As the primary transferring means for transferring a toner image from the drum 1 of each of the image formation stations Y, M, C and K, onto the belt 6, a primary transfer roller 10 is used. To the roller 10, primary transfer bias which is opposite in polarity from the toner is applied from an unshown bias power source, whereby the toner image on the drum 1 in each of the image formation stations Y, M, C and K is transferred (primary transfer) onto the belt 6. After the primary transfer of the toner image from the drum 1 in each of the image formation stations Y, M, C and K, onto the belt 6, the transfer residual toner, that is, the toner remaining on the peripheral surface of the drum 1 after the primary transfer, is removed by the cleaning device 4.

The above-described process is carried out for each of Y, M, C and K colors in synchronism with the rotation of the belt 6. Consequently, the toner images on the drums 1, one for one, are sequentially transferred in layers (primary transfer) onto the belt 6. Incidentally, when the image forming apparatus is in the monochromatic mode, the above described process is carried out in only the image formation station whose developing device 3 contains the toner which matches in color to the monochromatic image to be formed.

Meanwhile, the sheets P of recording medium in the recording medium cassette 11 are fed one by one by the feed roller 12 into the main assembly of the image forming apparatus, and then, are conveyed by the pair of registration roller 13 with a preset timing, to the secondary transfer nip, which is the area of contact between the belt 6 wrapped around a part of the peripheral surface of the roller 8, and the secondary transfer roller 14. The synthetic color toner image which has just been formed on the belt 6 by the primary transfer of the four monochromatic toner images, different in color, onto the belt 6, is transferred (secondary transfer) onto the sheet P of recording medium by the bias which is opposite in polarity from the toner and is being applied to the roller 14 from an unshown bias power source. The secondary transfer residual toner, that is, the toner remaining on the belt 6 after the secondary transfer, is removed by the intermediary transfer belt cleaning device 15. The direction indicated by a referential code YP is the direction in which the sheet P of recording medium is conveyed.

After the secondary transfer of the four monochromatic toner images, different in color, onto the sheet P of recording medium, they are fixed (welded) to the surface of the sheet P, while being mixed, by the fixing device 200 as an image heating device. Then, the combination of the sheet P and fixed image thereon, is discharged as a full-color print, into the delivery tray 17 through the sheet discharge passage 16.

(2) Fixing Device 200

Figure 2:
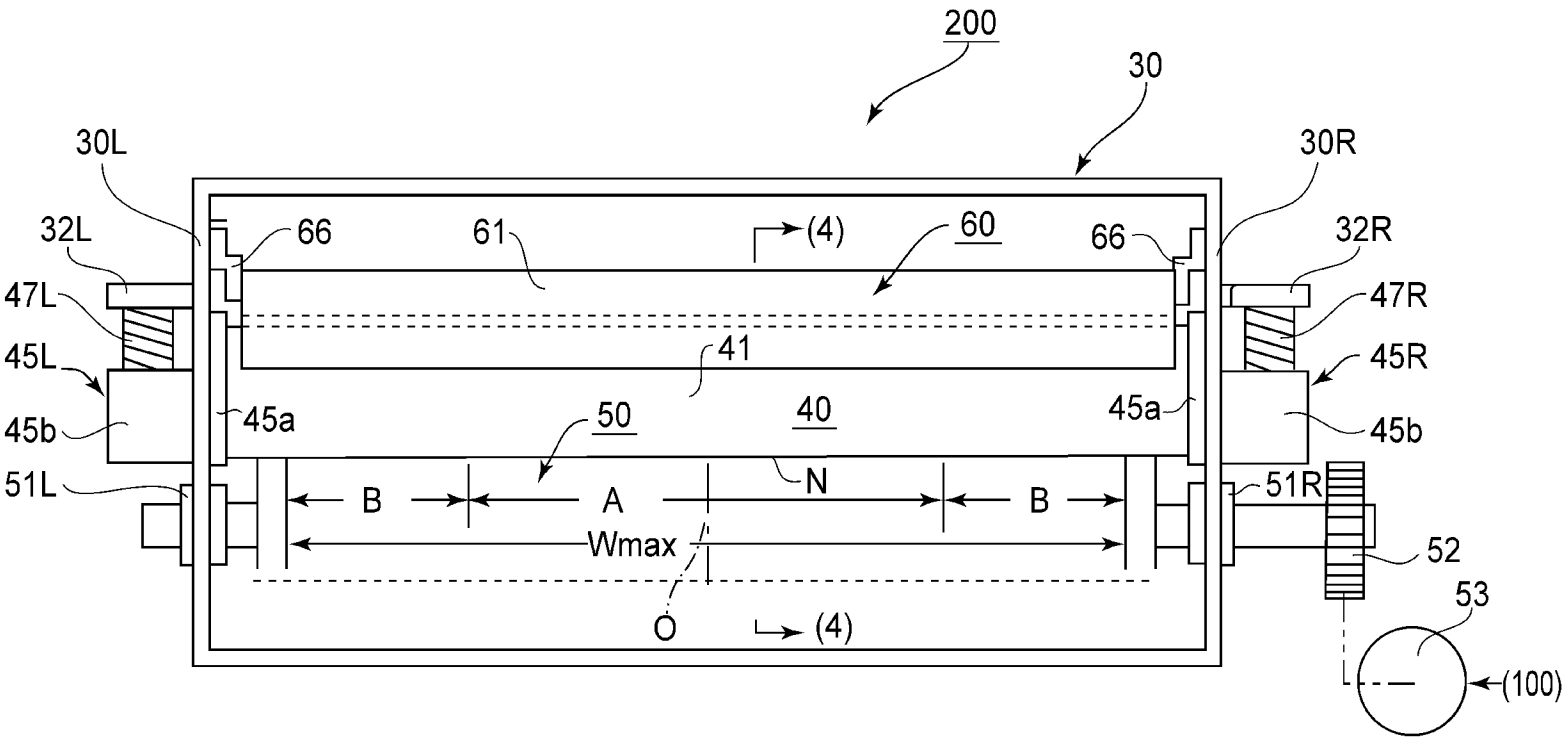
FIG. 2 is a schematic front view of the fixing device in the first embodiment of the present invention, and shows the essential portions of the device.
Figure 3:
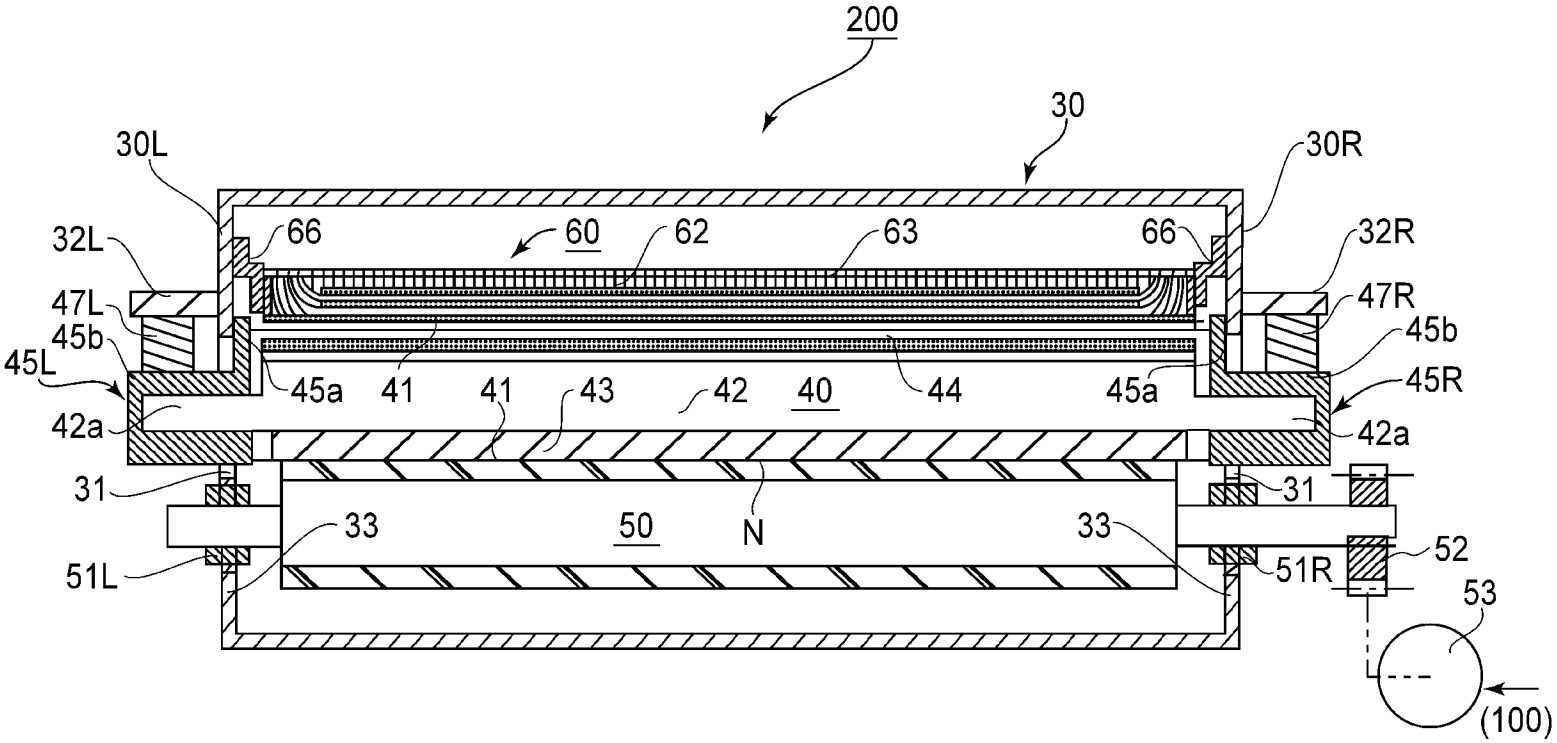
FIG. 3 is a schematic sectional view of the fixing device in the first embodiment, at a vertical plane parallel to the axial line of the rotational components of the device, and shows the essential portions of the device.
Figure 4:
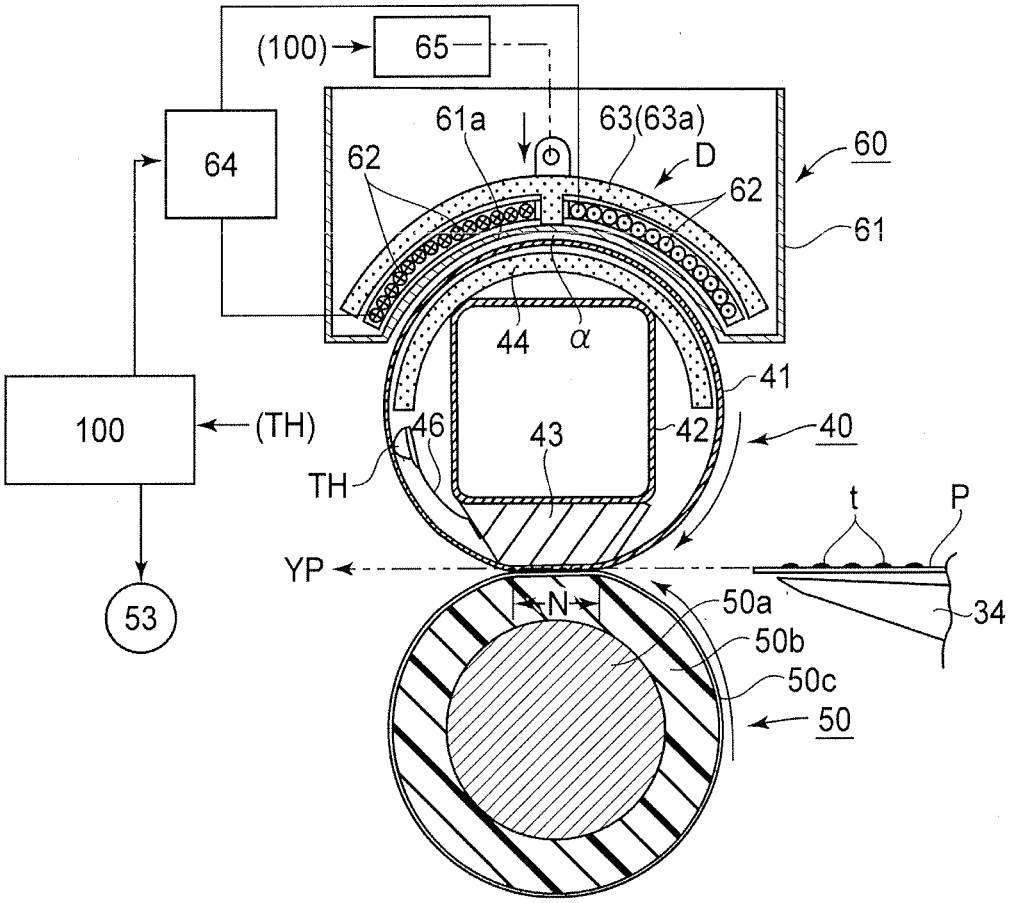
FIG. 4 is a schematic cross-sectional view of the fixing device in the first embodiment, at a plane (4)-(4) in FIG. 2, and shows the general structure of the device.

FIG. 2 is a schematic front view of the fixing device 200, and shows the essential portions of the device 200. FIG. 3 is a sectional view of the fixing device 200, at a vertical plane parallel to the lengthwise direction of the device 200, and shows the essential portions of the device 200. FIG. 4 is an enlarged sectional view of the fixing device 200, at a plane (4)-(4) in FIG. 2. In the following description of the fixing device 200, the lengthwise direction of the fixing device 200 and structural components thereof is the direction (thrust direction) of the axial line of each rotational members, or the recording medium conveyance direction YP, or the direction parallel thereto. The widthwise direction of the fixing device 200 or the structural components thereof is the direction which is parallel to the recording medium conveyance direction YP. Further, the lengthwise dimension of a given structural component of the fixing device 200 (image forming apparatus) is the dimension of the component in terms of its lengthwise direction.

Regarding the orientation of the fixing device 200, the front surface of the fixing device 200 means the surface of the device 200, which faces an operator (user) as the device 200 is seen by the operator from the recording medium entrance side of the device 200. The left or right of the fixing device 200 means the left or right of the device 200 as the device 200 is seen from the front side of the device 200. Further, the top or bottom of the fixing device 200 means the top or bottom of the device 200 in terms of the gravity direction. Further, the upstream or downstream of the fixing device 200 means the upstream or downstream of the device 200 in terms of the recording medium conveyance direction. The recording medium size (widthwise size) or recording medium passage width means the dimension of the sheet P of recording medium in terms of the direction perpendicular to the recording medium conveyance direction YP.

This fixing device 200 is an image heating device which employs a heating system based on electromagnetic induction. It is structured so that its magnetic field generating means is on the outward side of the heating member. Roughly speaking, the fixing device 200 has: a chassis 30 having a pair (left and right) of lateral plates 30L and 30R; a heating assembly 40; an elastic pressure roller 50; a coil unit 60 as a magnetic field generating means; etc. The heating assembly 40, pressure roller 50, and coil unit 60, etc., are disposed between the left and right lateral plates 30L and 30R.

(2-1) Heating Assembly 40

The heating assembly 40 has the first rotational member (heating member, rotational heating member, fixing member) 41, which is a magnetic member and is heated up by the electric current (eddy current) electromagnetically induced therein as it is moved through the area in which the magnetic field generated by the coil unit 60, which functions as a heating device (which will be described later), is present. In this embodiment, the rotational member 41 is in the form of a fixation belt (endless belt) 41, which is cylindrical and flexible. The heating assembly 40 has also a metallic stay 42 which is disposed on the inward side of the loop which the cylindrical fixation belt 41 forms. Further, the heating assembly 40 has a pressure pad 43, as a pressure applying member, which is attached to the bottom surface of the stay 42, in such a manner that it extends in the lengthwise direction of the stay 42.

The pad 43 is a member against which the pressure roller 50 is pressed, with the presence of the fixation belt 41 between the pad 43 and pressure roller 50, with the application of a preset amount of pressure, to form and maintain a nip N. It is formed of heat resistant resin. The stay 42 is desired to be rigid enough to withstand the pressure applied thereto to form and maintain the nip N. In this embodiment, therefore, it is made of iron. Further, the heating assembly 40 has a magnetism blocking core (internal magnetic core) 44, as a magnetism blocking member, for preventing the stay 42 from being increased in temperature by the heat generated therein by the electric current (eddy current) induced in the stay 24 by the function of the magnetic field generated by the coil unit 60. The magnetic blocking core 44 is disposed on the top side of the stay 42, in such an attitude that it extends in the lengthwise direction of the stay 42.

The stay 42 is provided with a pair of extension arms 42*a*, which extend from the lengthwise ends of the main portion of the stay 42, one for one, in the lengthwise direction of the stay 42, long enough to extend beyond the left and right edges of the belt 41, respectively. The left and right extension arms 42*a* are fitted with a pair of stay supports 45L and 45R, which are symmetrical in shape to each other. The belt 41 is loosely fitted around the assembly of the stay 42, pad 43 and core 44. The movement of the belt 41 in the lengthwise direction (left or right direction) is regulated by the flange 45*a* of each of the left and right stay supports 45L and 45R.

The fixing device 200 is provided with a temperature sensor TH (such as thermistor) as a temperature detecting means (temperature detection element for detecting the temperature of belt 41). The temperature sensor TH is attached to the pad 43, with the placement of the elastic supporting member 46 between itself and pad 43, being positioned at the center of the pad 43 in terms of the lengthwise direction of the pad 43. With the presence of the elastic supporting member 46 between the temperature sensor TH and pad 44, it is ensured that the temperature sensor TH is kept in contact with the inward surface of the belt 41 by the elastic supporting member 46. Therefore, even if the portion of the inward surface of the belt 41, with which the temperature sensor TH is in contact, is changed in position by being made to wave, the sensor TH is made, by the elastic supporting member 46, to follow the movement of the belt 41, remaining thereby satisfactorily in contact with the belt 46.

The above-described heating assembly 40 is disposed so that the pressure bearing portion 45*b* of the left stay support 45L fits in the vertical slit 31 of the lateral plate 35L, and the pressure bearing portion 45*b* of the right stay support 45R fits in the vertical slit 31 of the lateral plate 35R. Thus, the heating assembly 40 is allowed to freely move in the vertical direction along the vertical slits 31, between the left and right lateral plates 35L and 35R.

Figure 6:
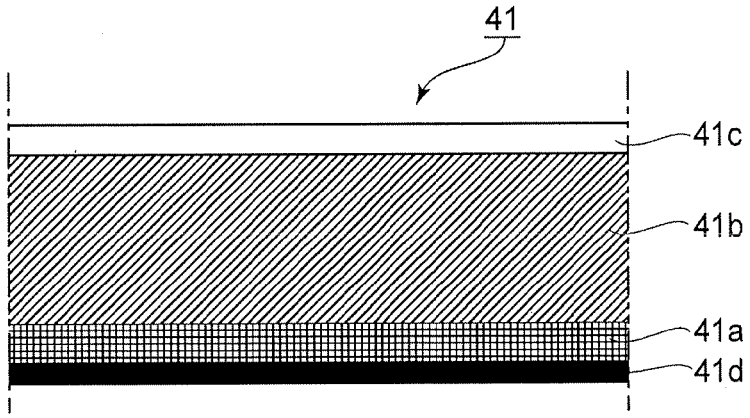
FIG. 6 is a schematic sectional view of the fixation belt in the first embodiment, at a plane perpendicular to the moving direction of the fixation belt. It shows the laminar structure of the fixation belt.

FIG. 6 is a schematic sectional view of the belt 41, and shows the laminar structure of the belt 41. In this embodiment, the lengthwise dimension of the belt 41 is 390 mm. It is 30 mm in internal diameter. It has a base layer (magnetic member, metallic layer) 41*a*, and an elastic layer 41*b*. The base layer 41*a* is made of nickel by electrical casting, and is 40 μm in thickness. The elastic layer 41*b* is formed of heat resistant silicone rubber, and is on the outward surface of the base layer 41*a*. The thickness of the silicone rubber layer (elastic layer 41*b*) is desired to be in a range of 100-1,000 μm.

In this embodiment, in consideration of the fact that in order to reduce the fixing device in warmup time, the belt 41 needs to be as small as possible in thermal capacity, and also, the fact that in order to obtain a desirably fixed image, an unfixed color image has to be fixed as satisfactorily as possible, the thickness of the silicone rubber layer 41*b* is made to be 300 μm in thickness. The "warmup" means the preparatory operation in which the main switch (main power switch) of the image forming apparatus is pressed down to begin supplying the image forming apparatus (fixing device) with electrical power, whereby the fixing device is readied for fixation (image heating). Thus, the "warmup time" means the length of time necessary for completing the "warm-up". Further, the operational mode in which the image forming apparatus (fixing device) is kept while the apparatus (device) is being warmed up is referred to as the warmup mode.

The silicone rubber used as the material for the silicone rubber layer 41*b* is 20° in JIS-A hardness scale, and is 0.8 W/mK in thermal conductivity. The belt 41 is also provided with a parting layer 41*c* as the surface layer, which is on the outward surface of the elastic layer 41*b* and is made of fluorinated resin (PFA and PTFE, for example), being 30 μm in thickness.

In order to reduce the friction between the inward surface of the belt 41 and the temperature sensor TH as a temperature detecting means, a resin layer (lubricant layer) 41*d* may be formed of fluorinated resin, polyimide, or the like, to a thickness of 10-50 μm, on the inward surface of the base layer 41*a*. In this embodiment, this lubricant layer 41*d* is made up polyimide, and is 20 μm in thickness.

The belt 41 is low in overall thermal capacity, and is flexible (elastic). When it is left unattended, it remains cylindrical. The material for the metallic layer 41*a* of the belt 41 may be selected from among metallic substances such as iron alloy, copper, silver, for example, in addition to nickel, in consideration of the properties of which the belt 41 is required. Incidentally, the belt 41 may be manufactured by depositing in a layer one of the above listed metals, on the resinous base layer. The thickness of the metallic layer 41*a* may be adjusted according to the frequency of the high frequency electric current to be flowed through the excitation coil (magnetic field generation coil) 62, which will be described later, and the permeability electrical conductivity of the metallic layer 41*a*. It is desired to be in a range of 5-200 μm.

(2-2) Pressure Roller 50

The pressure roller 50 functions as a rotational driving member for rotationally driving the belt 41. It is the second rotational member (pressure applying member, nip forming member, belt backing member). It is rotatably disposed on the downstream side of the heating assembly 40, in such an attitude that its axial line becomes roughly parallel to the lengthwise direction of the assembly 40. It is disposed between the left and right lateral plates 30L and 30R, with the placement of a pair of stationary bearings 51L and 51R between the lengthwise ends of the pressure roller 50 and the lateral plates 30L and 30R, respectively.

In this embodiment, the pressure roller 50 is an elastic roller made up of a metallic core 50*a*, an elastic layer 50*b*, and a parting layer 50*c* (surface layer). It is 30 mm in diameter. The metallic core 50*a* is cylindrical and is made of iron alloy. It is 20 mm in diameter, at its center in terms of the lengthwise direction, and is 19 mm in diameter, at the lengthwise ends. The elastic layer 50*b* is made of silicone rubber, and is placed on the peripheral surface of the metallic core 50*a*. The parting layer 50*c* is on the outward surface of the elastic layer 50*b*, and is formed of fluorinated resin (PFA, PTFE, for example). It is 30 μm in thickness. The lengthwise dimension of the pressure roller 50 is 350 mm. The hardness of the pressure roller 50 at its center in terms of its lengthwise direction is 70° in ASH-C hardness scale. The reason why the metallic core 50*a* is tapered is that with the metallic core 50*a* being tapered as described above, even if the pad 43 bends when it is under pressure, the fixation nip N formed between the pressure roller 50 and belt 41 by the pressing of the pressure roller 50 against the pad 43, with the presence of the belt 41 between the pad 43 and pressure roller 50, remains uniform in internal pressure across the entirety of the nip N in terms of its lengthwise direction.

The right end portion of the metallic core 50*a* is solidly fitted with a drive gear 52. As the driving force of the fixation motor (driving mechanism) 53, which is controlled by the control circuit 100, is transmitted to this drive gear 52 through the driving force transmission system (unshown), the pressure roller 50 is rotationally driven in the counterclockwise direction indicated by an arrow mark 50 in FIG. 4 (FIG. 5, as well) at a preset speed.

(2-3) Pressure Applying Portion

There are disposed a pair of stationary spring seats 32L and 32R, on the outward sides of the left and right lateral plates 30L and 30R, respectively. Further, there are disposed a pair of compression springs (elastic members) 47L and 47R, being kept compressed between the bottom surface of each of the bearing seats 32L and 32R, and the top surface of each of the pressure bearing portions 45*b* of the stay supports 45L and 45R, respectively.

The stay 42 is pressed downward along with the left and right stay support 45L and 45R by the force (pressure) generated by the resiliency of the left and right compression springs 47L and 47R. Thus, the pad 43 is kept pressed against the pressure roller 50, with the presence of the belt 41 between the pad 43 and pressure roller 50, compressing thereby the elastic layer 50*b* of the pressure roller 50. As a result, the fixation nip N, which has a preset width in terms of the recording medium conveyance direction YP, is formed between the belt 41 and pressure roller 50. In this case, the pad 43 functions as an auxiliary component for giving the nip N a preset profile in terms of internal pressure.

In this embodiment, the width of the nip N, that is, the distance between the upstream and downstream edges of the nip N in terms of the moving direction of the belt 41 is roughly 9.0 mm at each of the lengthwise ends, and roughly 8.5 mm, across the center portion of the lengthwise direction of the fixing device. This configuration is beneficial in that it makes the speed at which the sheet P of recording medium is conveyed by the lengthwise end portions of the pressure roller 50 greater than that by the center portion of the pressure roller 50, and therefore, the sheet P is unlikely to be wrinkled.

That is, the nip N for heating the image on the sheet P of recording medium while the sheet P is conveyed, remaining pinched by the belt 41 and pressure roller 50, through the nip N, is formed by the belt 41 as the first rotational member, and the pressure roller 50 as the second rotational member.

(2-4) Coil Unit 60

The coil unit 60 is a heat source (inductive heating means) for heating the belt 41 by the heat generated therein by the electric current (eddy current) induced in the belt 41 by a magnetic field. It is fixed to the left and right lateral plates 30L and 30R, being positioned above the heating assembly 40, that is, on the opposite side (180° opposite) of the heating assembly 40 from the pressure roller 50. The coil unit 60 is made up of a housing 61, an excitation coil 62, and a magnetic core 63. The excitation coil 62 and magnetic core 63 are attached to the housing 61.

The housing 61 is roughly in the form of a rectangular parallelepiped, and is molded of heat resistant resin (component molded of electrically insulating resin). It is positioned so that its lengthwise direction becomes parallel to the lengthwise direction of the fixing device, and also, that its bottom plate 61 faces the belt 41. The bottom plate 61*a* is shaped so that in terms of its cross section at a plane perpendicular to its lengthwise direction, it is bent inward of the housing 61 in such a manner that it conforms to the outward surface of the belt 41, covering thereby roughly half the belt 41 in terms of the circumferential direction of the belt 41. The opposite side of the housing 61 from the bottom plate 61*a* is wide open. The housing 61 is fixed to the left and right lateral plates 30L and 30R by its left and right ends, with the placement of a pair of brackets 66 between the housing 61 and left and right lateral plates 30L and 30R, one for one. It is positioned so that a preset amount of gap $\alpha$ is provided between the bottom plate 61*a* and the top surface of the belt 41.

Figure 7:
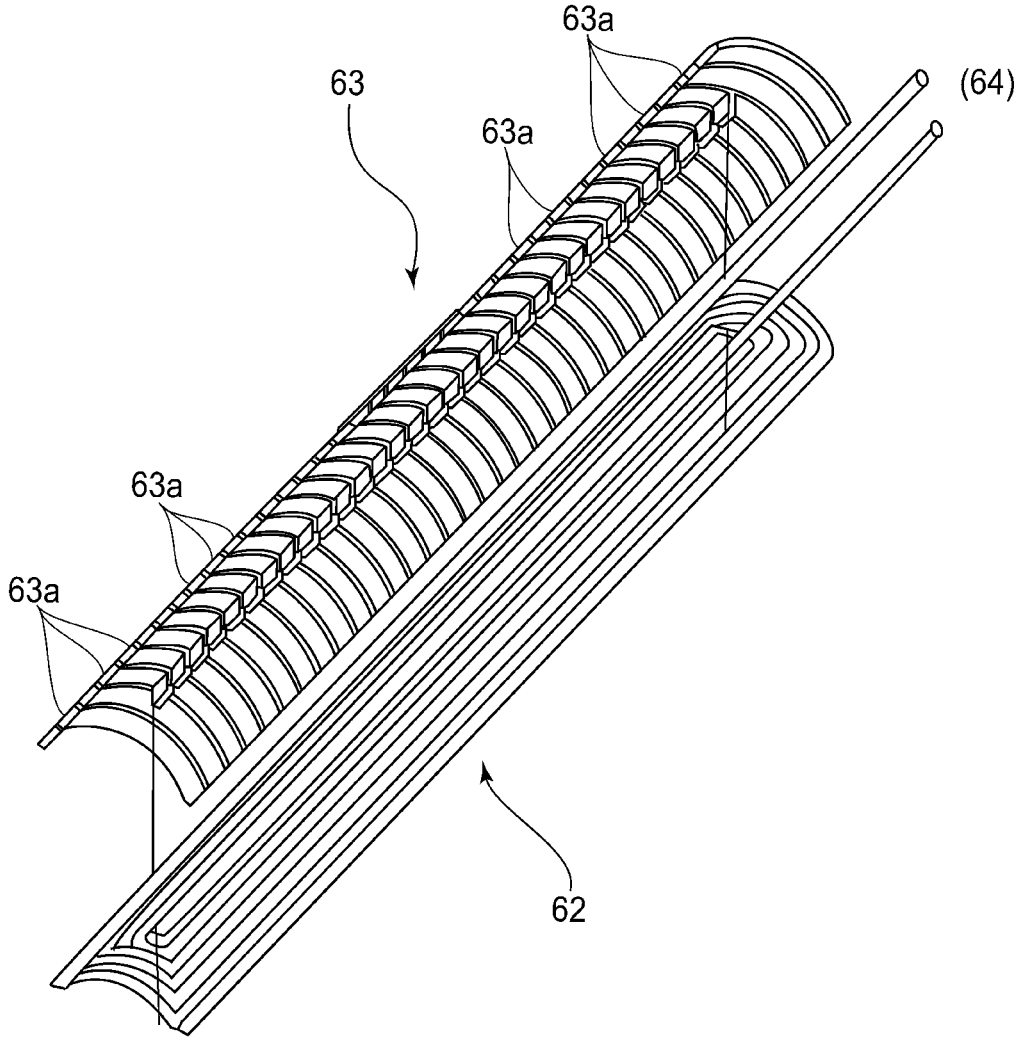
FIG. 7 is an exploded perspective view of the heating assembly made up of a coil and a core.

The coil 62 is made of Litz wire. It is wound several times, as shown in FIG. 7, being shaped like the bottom portion of a long and narrow boat, so that it conforms to the upwardly facing portion of the belt 41, and also, parts of the belt 41, which faces diagonally upward. It is placed in the housing 61, being positioned so that the recessed side of the coil 62 is placed in contact with the inward surface of the bottom plate 61*a*. Through the coil 62, high frequency current (20-50 kHz) is flowed from an electric power source (excitation circuit) 61 which is controlled by the control circuit 100.

The core 63 is an external magnetic core, which is shaped like the coil 62. It is positioned so that it can make it virtually impossible for the magnetic field generated by the coil 62, from leaking from the coil unit 60, except toward the metallic layer (electrically conductive layer) of the belt 64. Further, the core 63 is made up of multiple sections (which hereafter will be referred to as sub-core) 63*a*, which are independently movable in the direction to change their distance from the belt 41. The sub-cores 63*a* are aligned in parallel in the lengthwise direction of the belt 41, that is, the direction perpendicular to the recording medium conveyance direction. Further, they are shaped and positioned to surround the center of the coil 62 and its adjacencies.

That is, the coil unit 60 is positioned so that its lengthwise direction coincides with the lengthwise direction of the belt 41, which is perpendicular to the recording medium conveyance direction YP. Further, it has multiple sub-cores 63*a* which are independently movable in the direction to change their distance from the belt 41. The sub-cores 63*a* are aligned in the lengthwise direction of the belt 41, that is, the direction perpendicular to the recording medium conveyance direction. Further, the coil unit 60 is provided with a sub-core moving means (sub-core moving mechanism) 65, which is controlled by the control circuit 100 so that it can place each sub-core 63*a* in the first position D (FIG. 4), in which it is closest to the belt 41, and the second position E (FIG. 5), in which it is more distant from the belt 41 than when it is in the first position D.

Here, in order not to make the drawings excessively complicated, the concrete structure of the core moving means 65 is not shown. However, the core moving means disclosed in Japanese Laid-open Patent Application 2011-53597, for example, can be employed as the core moving means 65 in this embodiment.

(2-5) Fixation Operation

While the image forming apparatus is kept in the standby mode, the fixation motor 53 of the fixing device 200 is kept turned off, and therefore, the pressure roller 50 is not rotating. Further, the coil 62 of the coil unit 60 is not provided with electric power.

The control circuit 100 as a controller turns on the motor 53 with a preset control timing, in response to the inputting of a print start signal. Thus, the pressure roller 50 begins to be rotationally driven at a preset speed in the counterclockwise direction indicated by an arrow mark in FIG. 4.

This rotation of the pressure roller 50 generates friction between the peripheral surface of the pressure roller 50 and the outward surface of the belt 41, in the nip N. This friction causes the belt 41 to rotates. That is, the belt 41 is rotate by the pressure roller 50 in the clockwise direction indicated by the arrow mark Y41 (FIG. 5) at the same speed as the pressure roller 50, around the assembly of the stay 42, pad 43 and core 44, while remaining in contact with the bottom surface of the pad 43 by its inward surface. The movement of the belt 41 in the thrust direction, which might be caused by the rotational movement of the belt 41, is regulated by the flanges 45*a* of the left and right stay supports 45L and 45R.

At least while an image is formed, the pressure roller 50 is rotationally driven by the motor 53 which is under the control of the control circuit 100, whereby the belt 41 is rotated by the rotation of the pressure roller 50. The speed at which the belt 41 is rotated by the rotation of the pressure roller 50 is roughly the same as the speed at which a sheet P of recording medium, across which the unfixed toner image t is borne, is conveyed to the fixing device 200 from the secondary transfer nip. In this embodiment, the speed at which the outward surface of the belt 41 moves as the belt 41 is rotated by the rotation of the pressure roller 50 is 300 mm/sec. Thus, the fixing device 200 is capable of fixing 80 unfixed full-color images on 80 sheets of recording medium of A4 size, one for one, or 58 unfixed full-color toner images on 58 sheets of recording medium of A4R size, one for one, per minute.

The control circuit 100 supplies the coil 62 with alternating electrical current (high frequency current), the frequency of which is in a range of 20 kHz-50 kHz, for example, from the electric power source 64. As the coil 62 is supplied with the alternating current, an alternating magnetic flux (magnetic field) is generated. This alternating magnetic flux is guided by the core 63 to the metallic layer 41*a* of the portion of the belt 41, which is moving through the top side of the belt loop. Consequently, eddy current is induced in the metallic layer 41*a*. This eddy current generates heat (Joule' heat), which heats the belt 41; the metallic layer 41*a* is heated by the heat generated therein by the eddy current which is electromagnetically induced in the metallic layer 41*a*. Thus, the belt 41 increases in temperature.

That is, as a given portion of the belt 41 is conveyed through the area in which the magnetic field generate by the coil unit 60 is present, the metallic layer 41*a* of this portion of the belt 41 is heated by the heat generated in this portion of the metallic layer 41*a* by the eddy current electromagnetically induced in this portion of the magnetic layer 41*a* by the magnetic field generated by the coil unit 60. Eventually, the entirety of the belt 41 is heated, and therefore, increases in temperature. In this embodiment, the belt 41 is insulated from the coil 62 of the coil unit 60 by the 0.5 mm thick bottom plate 61*a* (molded of resin) of the housing 61. The gap between the belt 41 and coil 62 is uniform and is 1.5 mm (distance (gap $\alpha$) between bottom surface of bottom plate 61*a* of housing 60, and outward surface of belt 41 is 1.0 mm). Thus, the belt 41 is uniformly heated.

The temperature of the belt 41 is detected by the temperature sensor TH, which detects the temperature of the portion of the belt 41, which is within the recording medium passage in terms of the direction perpendicular to the recording medium conveyance direction. The information regarding the temperature detected by the temperature sensor TH is fed back to the control circuit 100. The control circuit 100 controls the electric power which is to be supplied from the electric power source 64 to the coil 62, in such a manner that the detected temperature (information about detected temperature) sent to the control circuit 100 from the temperature sensor TH remains at a preset target level (fixation temperature: information about preset temperature level).

More specifically, as the detected temperature of the belt 41 increases to the preset level, the power supply to the coil 62 is stopped. In this embodiment, in order to keep the temperature of the belt 41 stable at 180° C., which is the target temperature level, the high frequency current supplied to the coil 62 is changed in frequency to control the amount of electric power to be supplied to the coil 62 to control the belt 41 is temperature.

As the pressure roller 50 begins to driven, and the temperature of the belt 41 is increased to, and is kept at, the preset level (fixation temperature level), a sheet P of recording medium, across which the unfixed toner image t is borne, is guided into the nip N, in such an attitude that the image bearing surface of the sheet P faces the belt 41, while being guided by the guiding member 34. Then, the sheet P is conveyed through the nip N along with the belt 41, remaining in contact with the outward surface of the belt 41, and also, remaining pinched by the belt 41 and pressure roller 50.

Thus, the heat is given to the sheet P of recording medium and the unfixed toner image t on the sheet P, mainly from the belt 41. Further, as the sheet P is conveyed through the nip N, the sheet P and the unfixed toner image t thereon are also subjected to the internal pressure of the nip N. Consequently, the unfixed toner image t on the sheet P is fixed to the surface of the sheet P by the heat and pressure to which the sheet P and the unfixed toner image t are subjected. After the sheet P is conveyed through the nip N, it is separated from the outward surface of the belt 41 by the deformation (curvature change separation) of the belt 41, which occurs at the exit portion of the nip N. Then, the sheet P is conveyed out of the fixing device 200.

Since the coil unit 60 is positioned outside the belt loop, that is, it is not positioned on the inward side of the belt loop, which is higher in temperature than the outward side of the belt loop. Therefore, the coil unit 60 is less likely to become excessively high in temperature. Therefore, it is less likely to increase in electrical resistance during an image forming operation. Therefore, it is less in the amount of the loss attributable to the Joule's heat generated by the high frequency electric current than a conventional coil unit. Further, positioning the coil 62 outside the belt loop contributes to the reduction of the belt 41 in diameter (reduction in thermal capacity). Thus, the coil unit 60 in this embodiment is superior to a conventional one in terms of energy consumption.

The fixing device 200 in this embodiment is structured so that it is very small in thermal capacity. Therefore, as the coil 62 is supplied with 1,500 W of electrical power, the fixation nip N of the fixing device 200 can reach 180° C., or the target temperature level, in roughly 15 seconds.

(2-6) Control of Temperature Increase of Out-of-Sheet-Passage Portions of Fixation Belt Referring to FIG. 2, a referential code Wmax stands for the path of the widest sheet of recording medium conveyable through the fixing device 200. In this embodiment, the largest sheet of recording medium conveyable through the fixing device 200 is 13 inches in width and 19 inches in length, and is conveyed in such an attitude that its long edges become parallel to the recording medium conveyance direction. Therefore, the value of Wmax is 13 inches (330 mm).

A referential code A stands for the path of a sheet of recording medium which is less in width than the largest sheet of recording medium conveyable through the fixing device 200. The fixing device 200 in this embodiment is structured so that when a sheet of recording medium is conveyed through the fixing device 200, its center coincides with the center of the recording medium passage of the device 200 in terms of the widthwise direction of the recording medium passage. A referential code O stands for the center of the recording medium passage of the device 200. A referential code B stands for the out-of-sheet-path area, that is, the area of recording medium passage of the fixing device 200, which remains outside the recording medium path when a sheet of recording medium, which is smaller than the largest sheet of recording medium conveyable through the fixing device 200, is conveyed through the recording medium passage of the device 200. It is half of the difference between the value of the passage Wmax of the largest sheet of recording medium conveyable and the value of the path A of the smaller sheet of recording medium ((Wmax−A)/2). It occurs on both sides of the recording medium path A.

As a smaller sheet P of recording medium is conveyed through the fixing device 200, the thermal energy which the out-of-sheet-path portions of the belt 41 has is not consumed for heating the sheet P, but, it is the same in the amount per unit area as the heat generated in the portion of the belt 41 which is within the recording medium path A. Therefore, as a substantial number of small sheets of recording medium are continuously conveyed through the fixing device 200, the out-of-sheet-path portions of the belt 41 accumulates heat, becoming higher in temperature than the portion within the recording medium path A. That is, the so-called "out-of-sheet-path temperature increase phenomenon" occurs. Thus, the portions of the pressure roller 50, which are in contact with the out-of-sheet-path portions of the belt 41, also become higher in temperature than the portion of the pressure roller 50 which is within the recording medium sheet path A, because of the excessive temperature increase of the out-of-sheet-path portions of the belt 41.

$$L_{iER}E\{\text{obj,bkg}\}$$

$$L_{iER}E\{\text{obj,bkg}\}$$

In order for the belt 41 to be increased in temperature as quickly as possible, the belt 41 has to be reduced in thermal capacity. One of the methods for reducing the belt 41 in thermal capacity is to reduce the belt 41 in thickness. However, reducing the belt 41 in thickness by an amount large enough to significantly reduce the belt 41 in thermal capacity makes the belt 41 extremely small in the sectional area perpendicular to the rotational direction of the belt 41. Thus, the belt 41 becomes substantially less in terms of the thermal conduction in the direction perpendicular to its rotational direction. The thinner the belt 41 is made, the more conspicuous this phenomenon is. Further, in the case where the subtractive layer of the belt 41 is made of a substance such as resin which is low in thermal conductivity, the belt 41 is even smaller in the thermal conduction in the direction perpendicular to the rotational direction of the belt 41, which will be evident from Fourier's Law:

$$Q=\lambda\cdot f(\theta 1-\theta 2)$$

Q: amount of heat transmitted per unit length of time

λ: thermal conductivity

θ2−θ2: difference in temperature between two points

L: length.

When the largest (widest) sheet of recording medium (largest sheet of recording medium) is conveyed through the fixing device 200, this phenomenon is not problematic. However, when a substantial number of sheets of recording medium, which are smaller (narrower) than the widest sheet of recording medium, are continuously conveyed through the fixing device 200, the out-of-sheet-path portions of the belt 41 increase in temperature higher than the target temperature level. Consequently, the difference in temperature between the portion of the belt 41 which is within the sheet path, and the portions of the belt 41 which are out of the sheet path, becomes extremely large (out-of-sheet-path temperature increase).

Therefore, it is possible that the components of the fixing device 200, which are made of resinous substances and are disposed in the adjacencies of the belt 41, will be reduced in the length of their service life, and/or will be thermally damaged, by the excessive temperature increase of the out-of-sheet-path portions of the belt 41. In addition, it is possible that if a sheet of recording medium, which is wider than the substantial number of sheets of recoding medium which have just been continuously conveyed through the fixing device 200, is conveyed through the fixing device 200 immediately after the conveyance of the substantial number of narrower sheets, it will be wrinkled by the fixing device 200 because the belt 41 is not uniform in temperature, and/or the unfixed toner image on the sheet will not be uniformly fixed.

The greater in thermal capacity the sheet of recording medium, and/or the greater in throughput (print count per unit length of time) the fixing device, the greater the above described difference in temperature between the sheet path and out-of-sheet-path portions of the belt 41. Therefore, it has been difficult to use a fixing device which employs a fixation belt which is very low in thermal capacity, more specifically, a fixing belt which is very thin, as the fixing device for a copying machine or the like which is high in throughput.

In this embodiment, therefore, the fixing device 200 is structured so that in a case where a smaller sheet of recording medium is conveyed through the fixing device 200, the sub-cores 63*a* of the unit 60 are selectively moved to prevent the problem that the out-of-sheet-path portions of the belt 41 (pressure roller 50) excessively increase in temperature. Next, this setup is described.

a) Method for Preventing Out-of-Sheet-Path Portions of Fixation Belt Excessively Increasing in Temperature, by Selectively Moving Sub-Cores 63*a*

As described above, the core 63 of the unit 60 is disposed in parallel in the lengthwise direction of the fixing device 200. It is made up of sub-cores 63*a*, which are independently movable in the direction to change the distance between themselves and the belt 41. Further, the fixing device 200 is provided with the core moving mechanism 60, which can individually move the sub-cores 63*a* while being controlled by the control circuit 100.

When the sheet of recording medium to be conveyed through the fixing device 200 is smaller in width than the widest sheet of recording medium conveyable through the device 200, the control circuit 100 controls the core moving mechanism 65 so that the sub-cores 63*a* which are in the sheet path A of the smaller sheet are kept in their first distance position D, and the rest of the sub-cores 63*a* are moved into their second distance positions E.

Figure 5:
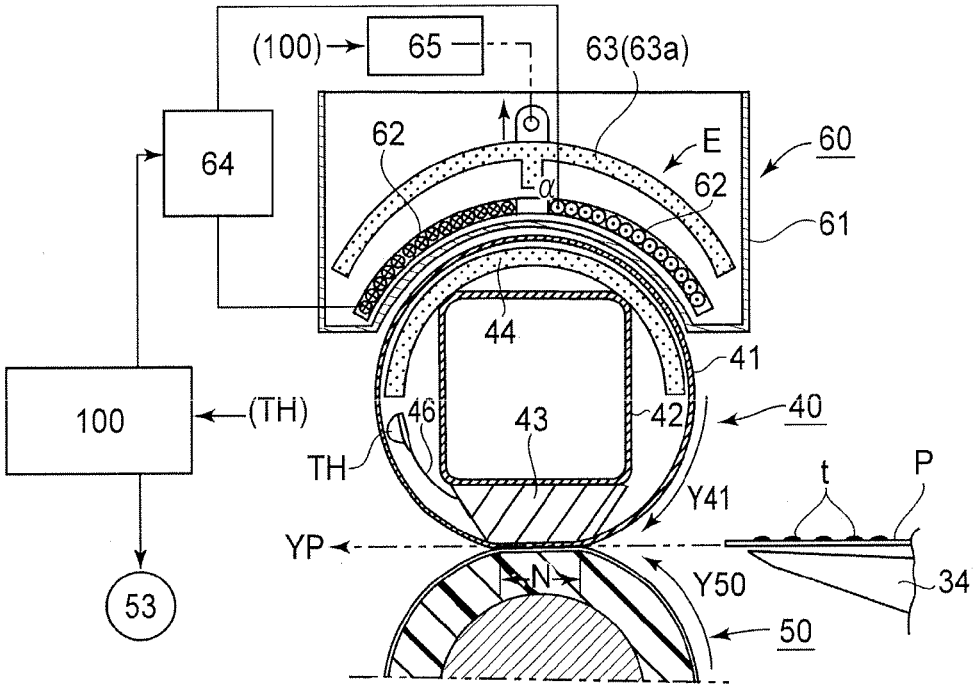
FIG. 5 is a schematic cross-sectional view of the fixing device in the first embodiment, at a plane (4)-(4) in FIG. 2, and shows the general structure of the device when the separable portion of the coil unit is in the second position.

In this embodiment, each sub-core 63*a* is movable so that it can be positioned in the first distance position D, in which it is closest to the coil 41, more specifically, 0.5 mm apart from the coil 41, as shown in FIG. 4, and in the second distance position E, in which it is farthest from the coil 41, more specifically, 1.0 mm apart from the coil 41, as shown in FIG. 5. When a given sub-core 63*a* is in its first distance position D, the portion of the belt 41, which corresponds in position to this sub-core 63*a*, is very high in heat generation efficiency. In comparison, when a given sub-core 63*a* is in its second distance position E, the portion of the belt 41, which corresponds in position to this sub-core 63*a*, is substantially less in heat generation efficiency than when the sub-core 63*a* is in its first distance position.

Thus, in order to enable the fixing device 200 to prevent the out-of-sheet-path portions of the belt 41 (pressure roller 50) from excessively increasing in temperature when such a sheet of recording medium as a postcard, and sheets of recording medium of A5, B4, A4 and A3 sizes, which is smaller in size (width) than the largest (widest) sheet of recording medium conveyable through the fixing device 200 is conveyed through the fixing device 200, the external magnetic core 60 is made up of multiple sub-cores 60*a* which are aligned in parallel in the direction perpendicular to the recording medium conveyance direction. That is, the sub-cores 60*a*, which are outside the sheet path, are moved away from the excitation coil 62 to reduce the out-of-sheet-path portions of the fixation belt 41 in magnetic flux density. In this embodiment, in terms of the direction perpendicular to the lengthwise direction of the excitation coil 62, the internal curvature of the excitation coil 62 is equivalent to the curvature of a circle which is 352 mm in diameter, and the external curvature of the excitation coil 62 is equivalent to the curvature of a circle which is 392 mm in diameter. Also in terms of the lengthwise direction of the external magnetic core 60, the sub-cores 63*a* of the external magnetic core 60 are 10 mm wide, and the gap between the adjacent two sub-cores 60*a* is 1.0 mm.

As a print job is started, the control circuit 100 reads the inputted value of the size of the sheet of recording medium to be conveyed. When the sheet of recording medium to be conveyed is the largest (widest) in size, the control circuit 100 controls the mechanism 65 so that all the sub-cores 60*a* are positioned in their first distance position D. When the sheet of recording medium to be conveyed is smaller in size (width) than the largest (widest) sheet of recording medium, the control circuit 100 controls the mechanism 65 so that the sub-cores 60*a*, which correspond in position to the path A of the smaller sheet of recording medium, are placed in their first distance position D, and the rest of the sub-cores 60*a* are placed in the second distance position E.

Therefore, the portions of the belt 41, which correspond in position to the out-of-sheet-path area B, is lower in heat generation efficiency than the portion of the belt 41, which corresponds in position to the sheet path area A. In other words, the out-of-sheet-path portions of the belt 41 (and pressure roller 50) are prevented from excessively increasing in temperature.

(3) Standby Mode

In this embodiment, in order to minimize the length of the time an operator (user) has to wait until the temperature of the fixation belt 41 reaches the proper level for fixation, the temperature of the fixation belt 41 is kept within a preset range (lowest acceptable level~highest acceptable level) as soon as the temperature of the fixation belt 41 increases to a certain level while the fixing device 200 is in the warmup mode. Then, the fixing device 200 is kept in the standby mode until a print start signal is inputted. In the standby mode, the fixing device 200 is controlled by the control circuit 100.

In a case where a print start signal is not inputted while the fixing device 200 is in the warmup mode, the fixing device 200 is put in the standby mode after the completion of the warmup mode. In a case where a print start signal is inputted while the fixing device 200 is in the standby mode, the above described image fixation sequence is carried out. After the completion of the image fixation sequence, the fixing device 200 is put in the standby mode again.

During the initial period in the standby mode into which the fixing device 200 is put while the fixing device 200 is in the warmup mode, the pressure roller 50 (entirety of roller 50 inclusive of not only parting layer 50*c*, but also, metallic core 50*a*) will have not been fully warmed up. Therefore, the heat which the coil unit 60 gives to the fixation belt 41 is conducted to the pressure roller 50 by a substantial amount. Thus, in a case where an image forming operation in which a substantial number of sheets of recording medium are continuously conveyed through the fixing device 200 is started soon after the fixing device 200 is put in the standby mode, the heat which the fixation belt 14 possesses will be robbed not only by the sheets of recording medium, but also, by the pressure roller 50. Therefore, it is possible for the fixation belt 41 to become excessively low in temperature.

Therefore, in order to prevent the fixation belt 41 from excessively reducing in temperature even in a case where an image forming operation in which a substantial number of sheets of recording medium are continuously conveyed through the fixing device 200 is started soon after the fixing device 200 is put in the standby mode, it is desired that the fixation belt 41 is heated even while the fixing device 200 is kept in the standby mode, in particular, during the initial period in the standby mode.

However, when the fixation belt 41 is heated, the fixation belt 41 is rotationally driven by the pressure roller 50. Therefore, the fixation belt 41 is likely to sustain abrasions attributable to the friction between the belt 41 and pad 43. Therefore, if the length of time the fixation belt 41 is heated (rotated) while it is in the standby mode becomes substantial, it is possible that the fixation belt 41 reduces in the length of its service life.

In this embodiment, therefore, for a preset length of time after the fixing device 200 is put in the standby mode, the lowest temperature level for the preset temperature range for the fixation belt 41 is set higher, and then, is reduced after the elapse of a preset length of time. Here, the "lowest temperature level" for the fixation belt 41 means the lowest temperature level in a preset temperature range for the fixation belt 41, in which it is unlikely for the fixation belt 41 to sustain the above described frictional abrasions, and the fixation belt 41 is unlikely to be reduced in the length of its service life.

Therefore, this embodiment can prevent the problem that the fixation belt 41 excessively reduce in temperature during the initial period after the fixing device 200 is put in the standby mode, without reducing the fixation belt 41 in the length of its service life.

Figure 8:
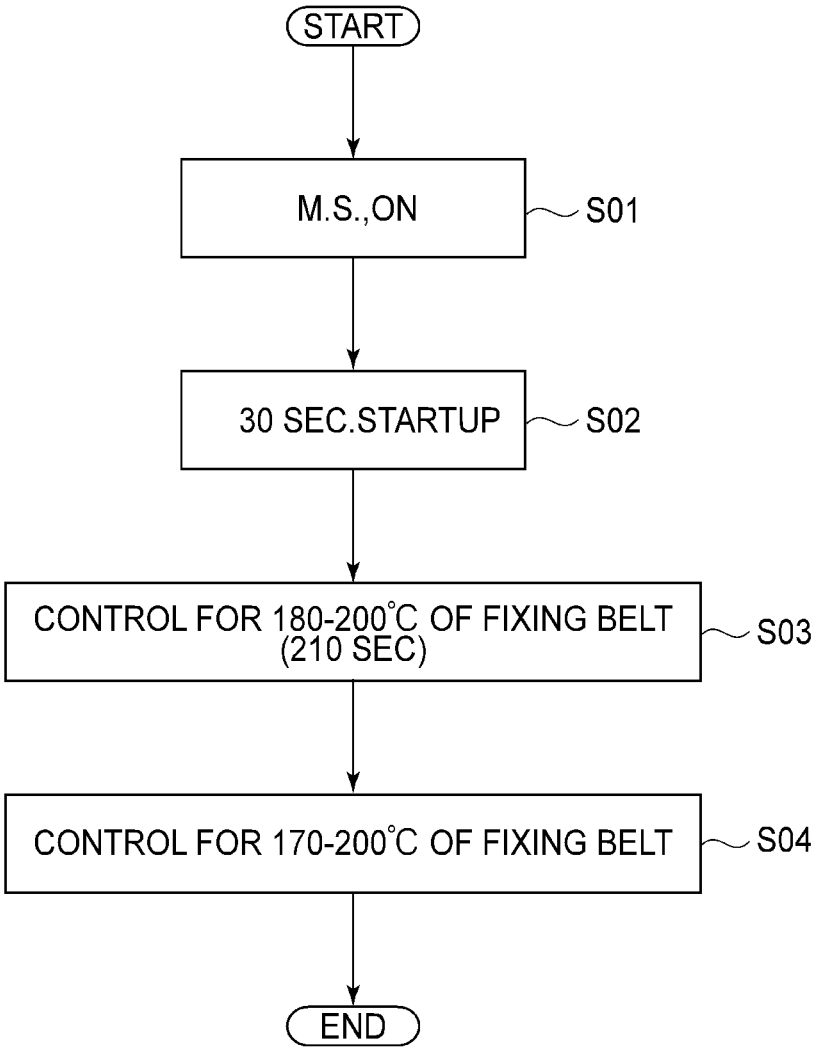
FIG. 8 is a flowchart of the operation of the fixing device in the first embodiment, in the standby mode in which the fixing device is placed during the startup of the device.
Figure 9:
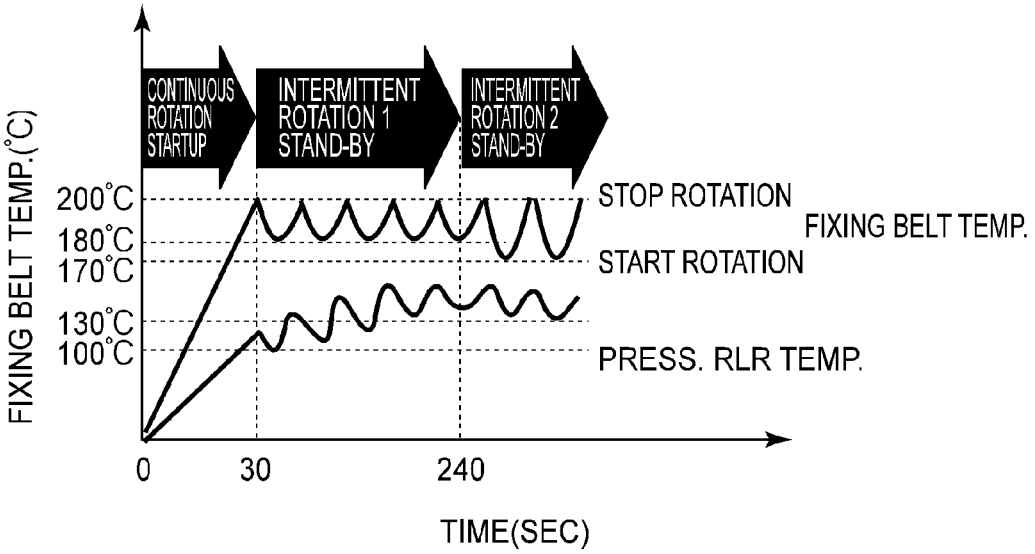
FIG. 9 is a graph which shows the changes in the temperature of the fixation belt and the changes in the temperature of the pressure roller, which occurred in the standby mode in which the fixing device in the first embodiment is placed during the startup of the fixing device.

FIG. 8 is a flowchart of the operation of the fixing device 200 in the standby mode in which the fixing device 200 in this embodiment is put while it is started up (in warmup mode). FIG. 9 is a graph which shows the relationship among the changes in the temperature of the fixation belt 41, change in the temperature of the pressure roller, and length of elapsed time, in the standby mode in which the fixing device in the first embodiment is placed during the startup of the fixing device. In this case, when the image forming apparatus was started up (when main switch of image forming apparatus was pressed, that is, when it began to be warmed up), it was in the ambience (room) which was 23° C. in temperature, and the temperature of the fixation belt 41 was roughly the same as the room temperature. Next, referring to FIGS. 8 and 9, the operation of the fixing device 200 (image forming apparatus) in the standby mode in which the fixing device 200 is put while the image forming apparatus started up is described. The sequential progression of the steps in this flowchart are controlled by the controlling of the various devices of the image forming apparatus by the control circuit 100.

Referring to FIG. 8, in Step S01, the main switch of the image forming apparatus is turned on, whereby the fixing device 200 is started up. That is, the fixing device 200 begins to be operated in the warmup mode.

In Step S02, various processes for starting up the fixing device 200 are carried out (fixing device is operated in warmup mode). More specifically, in order to increase the fixation belt 41 in temperature, electric power is continuously supplied to the coil 62 for 30 seconds to heat the fixation belt 41 while rotating the fixation belt 41 by driving the pressure roller 50 ("continuous startup rotation in FIG. 9). Thus, the temperature of the fixation belt 41 increases to 200° C. During this startup operation, the length of time the fixing device 200 is being operated in the warmup mode is measured with the internal timer of the control circuit 100. That is, the image forming apparatus (fixing device) is structured so that the operation of the image forming apparatus (fixing device) in the warmup mode ends as soon as 30 seconds (length of time measured with timer) elapses after the apparatus (device) is started up.

As Step S02 ends, that is, as soon as the operation in the warmup mode ends, the apparatus (fixing device) is put in the standby mode (S03, S04).

In Step S03, the electric power supplied to the coil 62 is controlled so that the temperature of the fixation belt 41 remains in a preset range (first temperature range) between 180° C. (lowest level) and 200° C. (highest level). As the temperature of the fixation belt 41 reaches 200° C., the electric power supply to the coil 62 is turned off. Then, as the temperature of the fixation belt 41 drops to 180° C., it is turned on again. This control is repeated. The driving of the pressure roller 50 is stopped at the same time as the electric power supply to the coil 62 is stopped. Further, the driving of the pressure roller 50 is started at the same time as the electric power supply to the coil 62 is started.

Next, the reason why the fixation belt 41 is kept preheated so that it temperature remains higher than 180° C. in the standby mode is described. Referring to FIG. 9, right after the fixing device 200 is put in the standby mode for the first time in a given image forming operation, the temperature of the pressure roller 50 will not have risen high enough for proper fixation. Therefore, as a print start signal is inputted, and a substantial number of sheets P of recording medium are continuously introduced into the nip N, the temperature of the fixation belt 41 is likely to excessively drop, because the heat of the fixation belt 41 is robbed not only by the sheets P of recording medium, but also, by the pressure roller 50.

In this embodiment, therefore, the lowest temperature for the fixation belt 41 in the standby mode is set to 180° C. to keep the fixation belt 41 preheated at a higher temperature level in the standby mode. Thus, even if a substantial number of sheets P of recording medium are continuously introduced into the nip N soon after the fixing device 200 is put in the standby mode, it is possible to prevent the temperature of the fixation belt 41 from excessively falling.

While the temperature of the fixation belt 41 falls from 200° C. to 180° C., the fixation belt 41 is not rotated (first intermittent rotation standby in FIG. 9). The reason for this control is as follows. While the fixation belt 41 is rotated, the inward surface of the fixation belt 41 is rubbed by the pad 43. That is, the reason why the fixation belt 41 is kept stationary while the temperature of the fixation belt 41 falls is to prevent the inward surface of the fixation belt 41 from being worn by the friction between itself and pad 43.

On the other hand, while the temperature of the fixation belt 41 increases from 180° C. to 200° C., the fixation belt 41 is continuously rotated. The reason for this procedure is as follows. In this embodiment, the area of fixation belt 41, which is heated by the coil 62, is local in terms of the moving direction of the fixation belt 41. Therefore, when the fixation belt 41 remains stationary, it is difficult to heat the entirety of the fixation belt 41 in terms of the moving direction of the fixation belt 41. That is, the reason why the fixation belt 41 is continuously rotated while the fixation belt 41 is increased in temperature is to heat the entirety of the fixation belt 41 in terms of the moving direction of the fixation belt 41.

Further, during a normal image forming operation (during normal image heating operation), the rotational speed (peripheral velocity) of the fixation belt 41 (pressure roller 50) is kept at 300 mm/s, whereas in the standby mode, it is reduced to 93 mm/s. That is, the speed at which the fixation belt 41 is rotated in the standby mode is set to be slower than the speed at which it is rotated while an image is actually heated. This arrangement also is for preventing the inward surface of the fixation belt 41 from being frictionally worn.

The process to be carried out in Step S03 to keep the temperature of the fixation belt 41 in the range between 180°-200° C. is to be continued for 210 seconds. In Step S03, the length of time the fixing device 200 is operated in the standby mode is measured by the above-described timer. Thus, as the length of time the fixing device 200 is operated in the standby mode since the fixing device 200 began to be operated reaches 210 seconds, the operation in the "first intermittent rotation standby mode" in FIG. 9 is ended. The number of times this process of heating, while rotating, the fixation belt 41 is intermittently carried out in this embodiment is 4.5 times.

In Step S04, the bottom level of the temperature range in which the temperature of the fixation belt 41 is to be kept in the standby mode is lowered from 180° C. to 170° C. That is, the fixing device 200 is controlled so that the temperature of the fixation belt 41 remains within a range (second temperature range) between 170° C. (lowest level) and 200° C. (highest level). More specifically, as the temperature of the fixation belt 41 reaches 200° C. 240 seconds after the fixing device 200 began to be started up, the electric power supply to the coil 26 is turned off. Then, as the temperature of the fixation belt 41 falls to 170° C., the electric power supply to the coil 26 is turned on again. This control of turning off and on the electric power supply is repeated. While the temperature of the fixation belt 41 falls from 200° C. to 170° C., the fixation belt 41 is kept stationary. While the temperature of the fixation belt 41 increases from 170° to 200° C., the fixation belt 41 is continuously rotated (second intermittent rotation standby in FIG. 9). That is, referring to FIG. 9, the fixing device 200 is controlled so that the period in the "second intermittent rotation standby" mode, in which the fixation belt 41 is not rotated (not heated) becomes longer than the period in the "first intermittent rotation standby" mode, in which the fixation belt 41 is not rotated (heated).

Next, the reason why as a preset length of time elapses after the ending of the operation in which the fixing device 200 is kept in the warmup mode (since beginning of operation in which fixing device 200 is operated in standby mode), the temperature of the fixation belt 41 is kept no lower than 170° C., instead of 180° C., is described. By the time when 240 seconds elapses after the fixing device 200 begins to be started up, heat will have sufficiently accumulated in the pressure roller 50, even in the metallic core 50*a*. Therefore, even if a substantial number of sheets P of recording medium are continuously introduced into the nip N, the heat which the fixation belt 41 has is unlikely to be robbed by the pressure roller 50 by a substantial amount. Therefore, even if the temperature of the fixation belt 41 is as low as 170° C., it is unlikely for the temperature of the fixation belt 41 to excessively fall. Further, lowering the bottom limit of the temperature range in which the temperature of the fixation belt 41 is to be kept reduces the amount by which the inward surface of the fixation belt 41 is worn by the friction between itself and pad 52.

Figure 10:
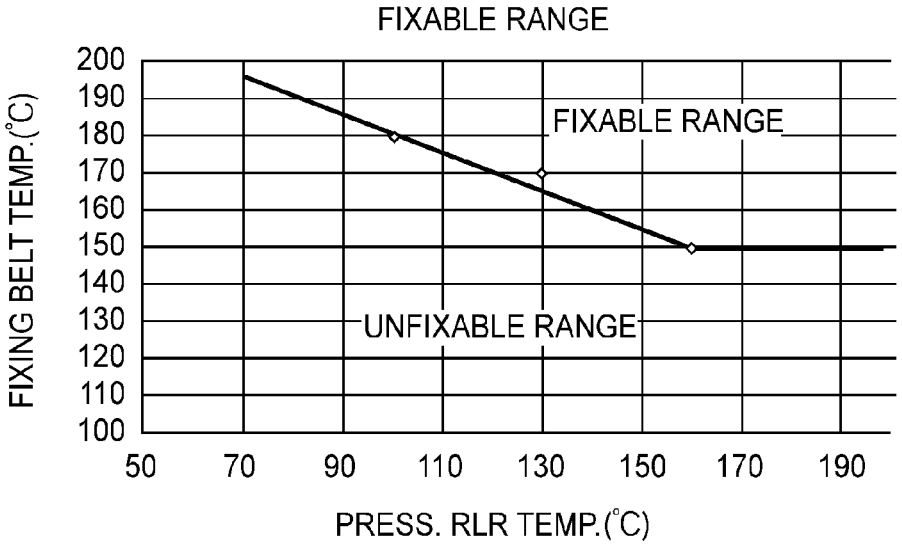
FIG. 10 is a graph which shows the temperature range in which the fixing device in the first embodiment can properly fix the toner image on a sheet of recording medium.
Figure 11:
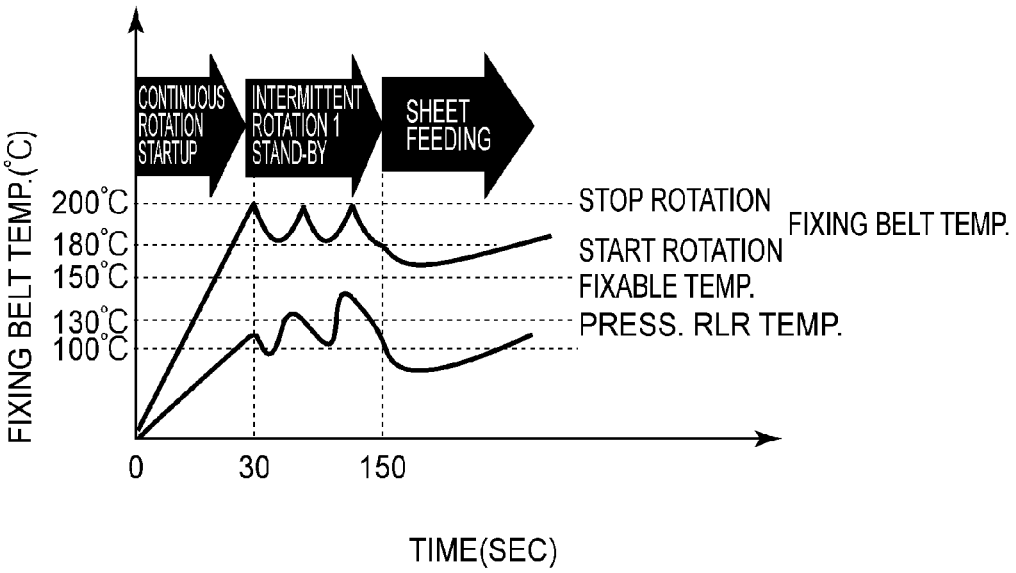
FIG. 11 is a graph which shows the changes in the temperature of the fixation belt and pressure roller of the fixing device in the first embodiment, which occurred as a substantial number of sheets of recording medium were conveyed through the fixing device.

Shown in FIG. 10 is the temperature range in which the fixing device 200 can properly function. FIG. 11 a drawing for describing the changes in the temperature of the fixation belt 41 and pressure roller 50 of the fixing device 200 in this embodiment, which occur as multiple sheets of recording medium are conveyed through the fixing device 200. Referring to FIG. 11, even if multiple sheets of recording medium are conveyed through the nip N, the temperature of the fixation belt 41 did not fall below 150° C., which is the lowest level of the temperature range in which the fixing device 200 can properly function ("sheet conveyance" in FIG. 11).

As will be evident from the detailed description of this embodiment, this embodiment can prevent the problem that as a fixing device is made to start an operation for continuously fixing a substantial number of images shortly after it was put in standby mode, the fixing device excessively reduces in temperature. Further, it can significantly reduce the amount by which the fixation belt of a fixing device is reduced in the length of its service life while the fixing device is kept in the standby mode.

Embodiment 2

Next, another embodiment of the present invention is described. The components (and parts thereof) of the fixing device in this embodiment, which are the same as the counterparts in the first embodiment, are not described. In the first embodiment, it was based on the length of time from when the fixing device 200 was turned on that the fixing device 200 was switched in the manner in which the fixation belt 41 is controlled in temperature. In comparison, in this embodiment, it is based on the temperature of the pressure roller 50 that the fixation belt 41 is controlled in temperature while the fixing device is kept in the standby mode.

Figure 13:
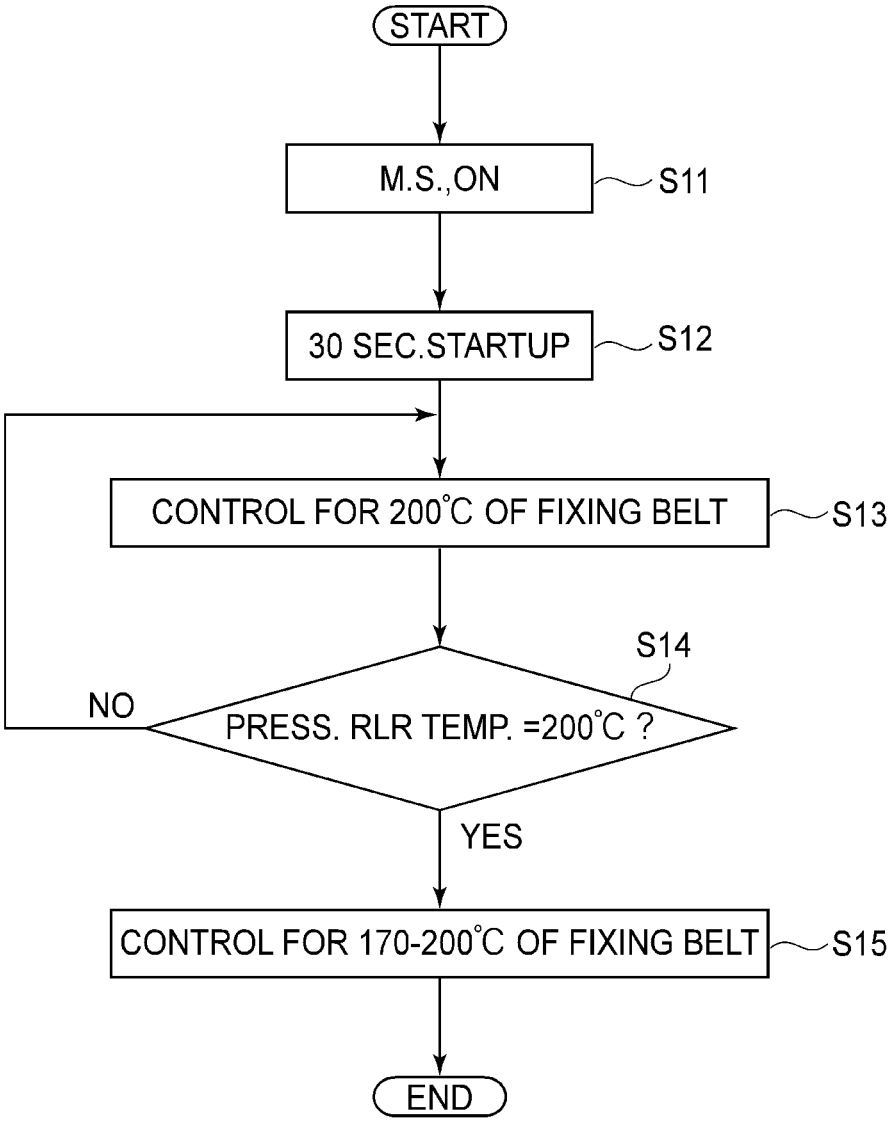
FIG. 13 is a flowchart of the operation of the fixing device in the second embodiment, in the standby mode in which the device is placed while the device is started up.
Figure 14:
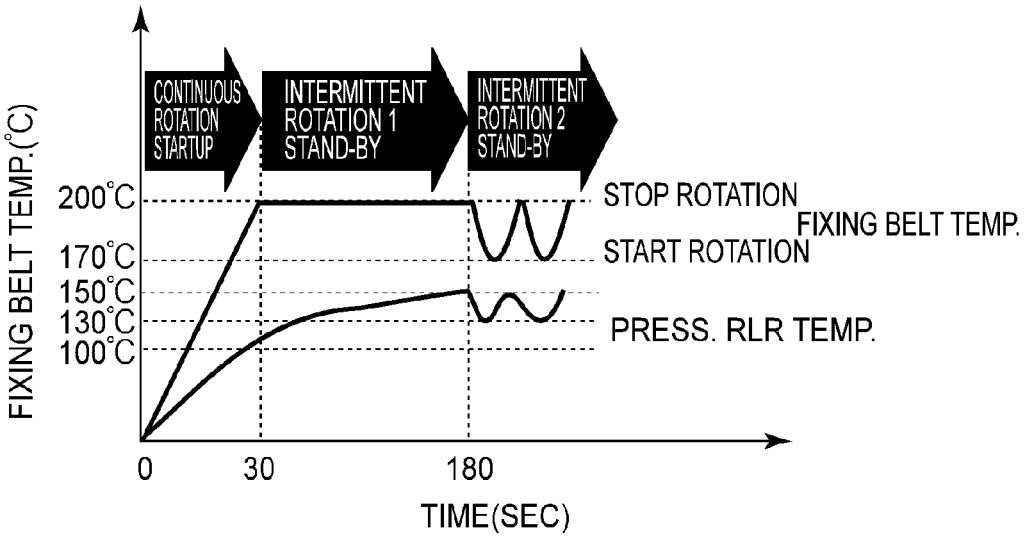
FIG. 14 is a graph which shows the changes in the temperature of the fixation belt and pressure roller of the fixing device in the second embodiment, which occurred in the standby mode in which the fixing device is put during the startup of the fixing device.

FIG. 13 is a flowchart of the operation to be carried out by the fixing device 200 in this embodiment as the fixing device 200 is put in the standby mode for the first time after the image forming apparatus is turned on. FIG. 14 is a drawing (graph) for describing the changes in the temperature of the fixation belt 41, and changes in the temperature of the pressure roller 50, which occurred with the elapse of time after the fixing device was put in the standby mode for the first time while the fixing device 200 was started up. When the fixing device 200 was turned on, the ambient temperature (room temperature) was 23° C., and therefore, the temperature of the fixation belt 41 was also 23° C., that is, it was the same as that of the ambient temperature (room temperature). Next, referring to FIGS. 13 and 14, the steps in this flowchart are carried out by the various components of the fixing device 200 which are under the control of the control circuit 100. The temperature sensor TH1, which will be described later, is in connection to the control circuit 100. Thus, the information regarding the temperature of the pressure roller 50 detected by the temperature sensor TH1 is inputted into the control circuit 100.

Referring to FIG. 13, Step S11 is the same as Step S01 in FIG. 8, and therefore is not described. Step S12 is the same as Step S02, and therefore, it also is not described.

In Step S13, the electric power supply to the coil 62 is controlled so that the temperature of the fixation belt 41 remains at 200° C. while the process of rotating (heating) the fixation belt 41 and the process of keeping the fixation belt 41 stationary are alternately repeated (first intermittent rotation standby in FIG. 14). That is, the fixation belt 41 is intermittently rotated (heated).

Figure 12:
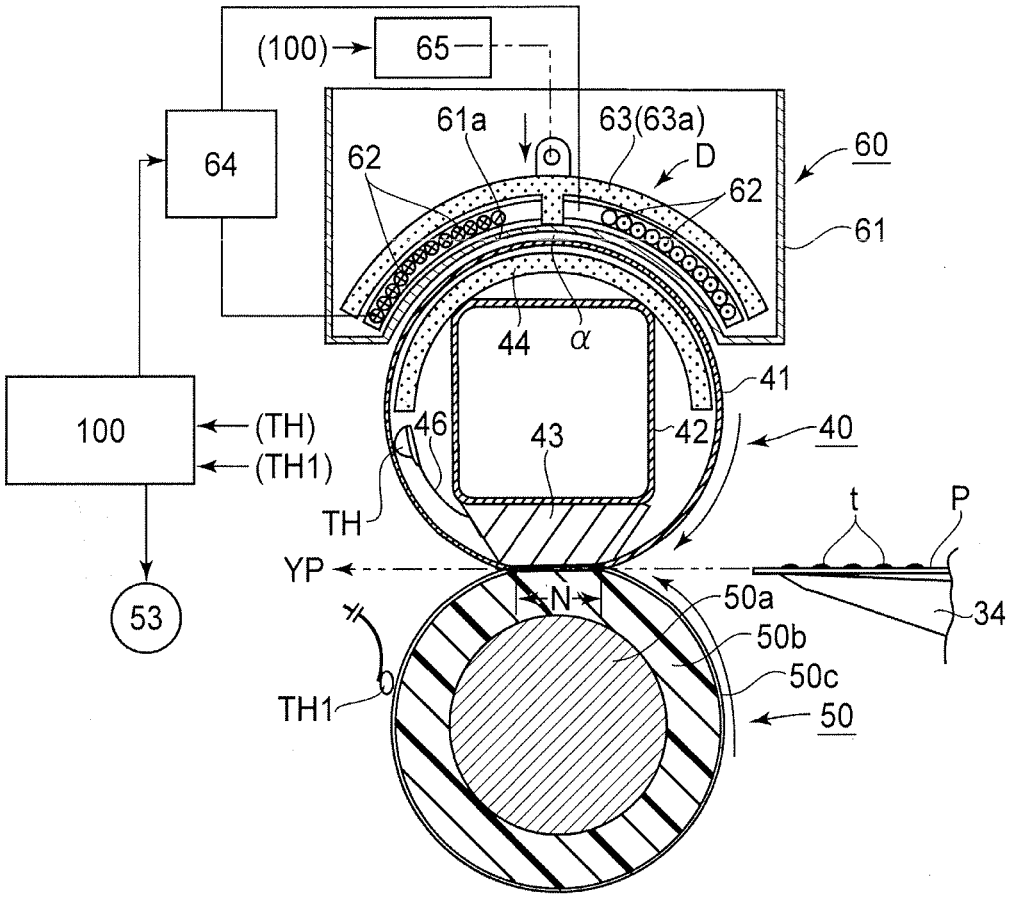
FIG. 12 is a schematic cross-sectional view of the fixing device in the second embodiment of the present invention, and shows the general structure of the device.

In Step S14, it is checked whether or not the temperature of the pressure roller 50 has reached a preset level, which is 150° C. in this embodiment. The temperature of the pressure roller 50 is detected by the sensor TH1 (FIG. 12), which detects the surface temperature of the center portion of the pressure roller 50 in terms of the lengthwise direction. If the temperature of the pressure roller 50 has not reached 150° C. in Step S14, the control circuit 100 returns to Step S13. As the temperature of the pressure roller 50 reaches 150° C., the control circuit 100 advances to Step S15.

In Step S15, the fixing device 200 is switched in operational mode to the one in which the temperature of the pressure roller 50 is kept in a range between 170° C. and 200° C. ("second intermittent rotation standby" in FIG. 14). In this "second intermittent rotation standby" mode, while the temperature of the fixation belt 41 falls from 200° C. to 170° C., the fixation belt 41 is not rotated, whereas while the temperature of the fixation belt 41 rises from 170° C. to 200° C., the fixation belt 41 is continuously rotated. That is, the fixing device 200 is controlled as shown in FIG. 14 so that the period in the "second intermittent rotation standby" mode, in which the fixation belt 41 is not rotated (not heated), becomes longer than the period in the "first intermittent rotation standby" mode, in which the fixation belt 41 is not rotated (not heated). The reason why this control is carried out is as follows. It is reasonable to think that by the time when the temperature of the pressure roller 50 reaches 150° C., the pressure roller 50 sufficiently accumulates heat. Therefore, even if the fixing device 200 is switched in the temperature control setup in the standby mode, the changes in the temperature of the pressure roller 50 remains within a range of 130° C.-150° C., as shown in FIG. 14. Therefore, it is unlikely for the temperature of the fixation belt 41 to excessively fall ("second intermittent rotation standby" in FIG. 14).

The fixing device 200 in this embodiment may be modified in structured so that it is switched in the temperature control in the standby mode, based on both the temperature of the pressure roller 50, and the length of the time from when the fixing device 200 is turned on. For example, it may be structured so that while it is in the standby mode, it is switched in the temperature control, based on whichever is earlier, the timing with which the temperature of the pressure roller 50 reaches 150° C., or 240 seconds after the fixing device 200 is turned on.

Figure 15:
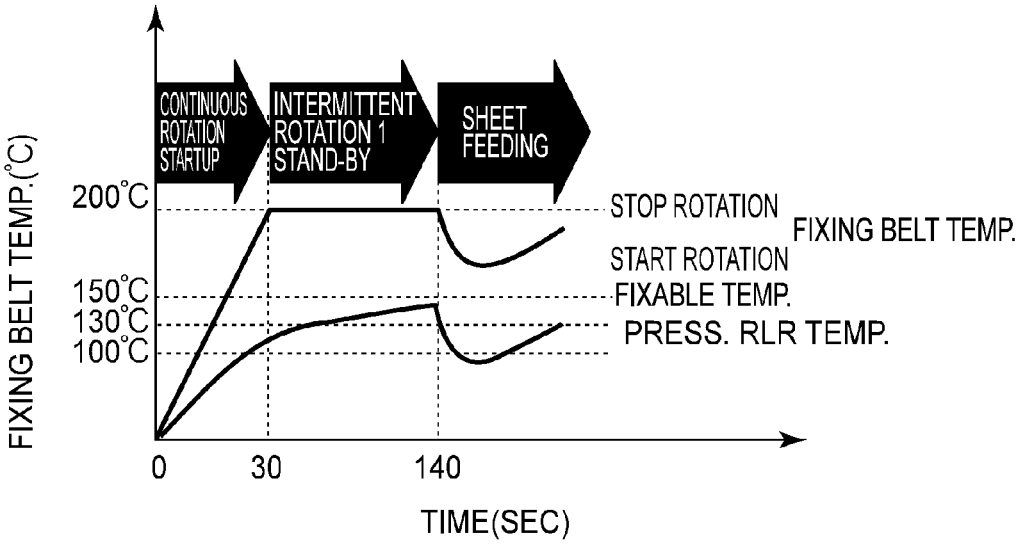
FIG. 15 is a graph which shows the changes in the temperature of the fixation belt and pressure roller of the fixing device in the second embodiment, which occurred in the standby mode as a substantial number of sheets of recording medium were conveyed through the fixing device.

FIG. 15 is a drawing which shows the changes in the temperature of the fixation belt 41 and pressure roller 50, which occurred after the fixing device 200 was put in the standby mode for the first time after the image forming apparatus was turned on. As is evident from FIG. 15, even if a substantial number of sheets of recording medium are introduced into the nip of the fixing device 200, it does not occur that the temperature of the fixation belt 41 falls below 150° C. ("recording medium conveyance" in FIG. 15).

As described above, the fixing device 200 in this embodiment, and the fixing device 200 in the modified version of this embodiment are unlikely to suffer from the problem that as they are put in the standby mode, their fixation belt 41 excessively reduces in temperature during the initial period in the standby mode, and also, the problem that their fixation belt 41 is significantly reduced in the length of its service life.

[Miscellanies]

The heat source (heating device) for heating the fixation belt 41 does not need to be the coil unit 60. That is, the fixing device 200 may be structured so that a heat source other than the coil unit 60 is used as the heat source; it may be structured so that a halogen heater, an infrared lamp, or a ceramic heater, for example, is used as the heat source.

The usage of an image heating apparatus in accordance with the present invention is not limited to the usage as a fixing device such as the fixing devices in the preceding embodiments. For example, it can be effectively used as a glossing apparatus (image property improving apparatus) for improving a fixed image on a sheet of recording medium in properties by heating the image.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 230785/2012 filed Oct. 18, 2012, which is hereby incorporated by reference.

What is claimed is:

1. An image heating apparatus comprising:

an endless belt configured and positioned to heat a toner image on a sheet in a nip;

a driving rotatable member configured and positioned to cooperate with said endless belt to form the nip and to rotate said endless belt;

a pressing pad configured and positioned to press said endless belt from an inside of said endless belt toward said driving rotatable member;

a heating device configured and positioned to heat said endless belt; and a controller configured to execute, in a stand-by mode following a warming-up mode, an intermittent heating operation of said heating device for said endless belt while rotating said endless belt by said driving rotatable member, wherein said controller is configured to execute, after executing the intermittent heating operation in a first period in the stand-by mode, the intermittent heating operation in a second period in the stand-by mode, wherein intervals of the intermittent heating operation are longer in the second period than in the first period.

2. An apparatus according to claim 1, wherein said controller sets a peripheral speed of said endless belt in the stand-by mode at a level lower than a peripheral speed of said endless belt in an image heating process operation.

3. An apparatus according to claim 1, wherein said controller is configured to execute, in the standby mode, the intermittent heating operation in the first period for a predetermined duration and then the intermittent heating operation in the second period.

4. An apparatus according to claim 1, wherein said controller is configured to execute, in the stand-by mode, a predetermined number of times of the intermittent heating operations in the first period and then the intermittent heating operation in the second period.

5. An apparatus according to claim 1, further comprising a temperature sensor configured and positioned to detect the temperature of said driving rotatable member, wherein when a detected temperature of said temperature sensor becomes higher than a predetermined temperature, said controller finishes the intermittent heating operation for the first period and starts the intermittent heating operation for the second period.

6. An apparatus according to claim 1, wherein said heating device heats said endless belt locally with respect to a circumferential direction of said endless belt.

7. An apparatus according to claim 6, wherein said heating device includes an excitation coil configured to generate a magnetic flux for causing electromagnetic induction heat generation in said endless belt.

8. An apparatus according to claim 1, wherein said driving rotatable member includes a cylindrical metal core, an elastic layer on the metal core, and a toner parting layer on the elastic layer.

9. An image heating apparatus comprising:

an endless belt configured and positioned to heat a toner image on a sheet in a nip;

a driving rotatable member configured and positioned to cooperate with said endless belt to form the nip and to rotate said endless belt;

a pressing pad configured and positioned to press said endless belt from an inside of said endless belt toward said driving rotatable member;

a heating device configured and positioned to heat said endless belt;

a temperature sensor configured and positioned to detect a temperature of said endless belt; and a controller configured to control said heating device and said driving rotatable member in accordance with an output of said temperature sensor, wherein in a stand-by mode said controller is configured to execute a first mode and a second mode;

wherein in the first mode, said controller stops said heating device and said driving rotatable member when a temperature of said endless belt rises to an upper limit temperature of a first temperature range, said controller operates said heating device and said driving rotatable member when the temperature of said endless belt decreases to a lower limit temperature of the first temperature range, and wherein in the second mode, said controller stops said heating device and said driving rotatable member when the temperature of said endless belt rises to an upper limit temperature of a second temperature range, and said controller operates said heating device and said driving rotatable member when the temperature of said endless belt decreases to a lower limit temperature of the second temperature range which is lower than that of the first temperature range.

10. An apparatus according to claim 9, wherein said controller sets a peripheral speed of said endless belt in the stand-by mode at a level lower than a peripheral speed of said endless belt in an image heating process operation.

11. An apparatus according to claim 9, wherein an upper limit temperature of the first temperature range is substantially the same as an upper limit temperature of the second temperature range.

12. An apparatus according to claim 9, wherein in the stand-by mode, said controller is configured to execute control of said heating device so that the temperature of said endless belt is maintained within the first temperature range for a predetermined duration, and then to execute control of said heating device so that the temperature of said endless belt is maintained within the second temperature range.

13. An apparatus according to claim 9, further comprising a temperature sensor configured and positioned to detect a temperature of said driving rotatable member, wherein when a detected temperature of said temperature sensor becomes higher than a predetermined temperature, said controller finishes the control of the heating device based on the first temperature range and starts the control of said heating device based on said second temperature range.

14. An apparatus according to claim 9, wherein said heating device heats said endless belt locally with respect to a circumferential direction of said endless belt.

15. An apparatus according to claim 14, wherein said heating device includes an excitation coil configured to generate a magnetic flux for causing electromagnetic induction heat generation in said endless belt.

16. An apparatus according to claim 9, wherein said driving rotatable member includes a cylindrical metal core, an elastic layer on the metal core, and a toner parting layer on the elastic layer.

17. An image heating apparatus comprising:

an endless belt configured and positioned to heat a toner image on a sheet in a nip;

a driving rotatable member configured and positioned to cooperate with said endless belt to form the nip and to rotate said endless belt;

a pressing pad configured and positioned to press said endless belt from an inside of said endless belt toward said driving rotatable member;

a heating device configured and positioned to heat said endless belt; and a controller configured to execute, in a stand-by mode following a warming-up mode, an intermittent heating operation of said endless belt by said heating device, while rotating said endless belt by said driving rotatable member, wherein said controller is configured to execute a first mode operation in which said heating operation is intermittently carried out, and a second mode operation in which said heating operation is intermittently carried out, wherein intervals of the intermittent heating operation are longer in the second period than in the first period.

18. An apparatus according to claim 17, further comprising a measuring portion configured to measure an elapse of time of a state of the stand-by mode, wherein said controller executes the first mode operation when the time measured by said measuring portion is less than a predetermined time, and executes the second mode operation when the time measure by said measuring portion is not less than the predetermined time.

19. An apparatus according to claim 17, further comprising a temperature sensor configured and positioned to detect a temperature of said driving rotatable member in the stand-by mode, wherein when a detected temperature of said temperature sensor is less than a predetermined temperature, said controller executes the first mode operation, and when the detected temperature of said temperature sensor is not less than the predetermined temperature, said controller executes the second mode operation.

* * * * *